US007784563B2

(12) United States Patent
Rödland et al.

(10) Patent No.: US 7,784,563 B2
(45) Date of Patent: Aug. 31, 2010

(54) METHOD, DRILLING MACHINE, DRILL BIT AND BOTTOM HOLE ASSEMBLY FOR DRILLING BY ELECTRICAL DISCHARGE BY ELECTRICAL DISCHARGE PULSES

(75) Inventors: Arild Rödland, Trondheim (NO); Vladimir V. Lopatin, Tomsk (RU); Vasili M. Muratov, Tomsk (RU); Vladislav F. Vajov, Tomsk (RU)

(73) Assignee: Unodrill AS, Trondheim (NO)

( * ) Notice: Subject to any disclaimer, the term of this patent is extended or adjusted under 35 U.S.C. 154(b) by 550 days.

(21) Appl. No.: 10/581,022

(22) PCT Filed: Nov. 30, 2004

(86) PCT No.: PCT/NO2004/000369

§ 371 (c)(1),
(2), (4) Date: Nov. 9, 2007

(87) PCT Pub. No.: WO2005/054620

PCT Pub. Date: Jun. 16, 2005

(65) Prior Publication Data

US 2009/0133929 A1 May 28, 2009

(30) Foreign Application Priority Data

Dec. 1, 2003 (NO) ..... 20035338

(51) Int. Cl.
*E21B 7/15* (2006.01)

(52) U.S. Cl. ..... 175/16

(58) Field of Classification Search ..... 175/16
See application file for complete search history.

(56) References Cited

U.S. PATENT DOCUMENTS 3,467,206 A * 9/1969 Acheson et al. ..... 175/13
7,270,195 B2 * 9/2007 MacGregor et al. ..... 175/16

* cited by examiner

*Primary Examiner*—William P Neuder
(74) *Attorney, Agent, or Firm*—Dennison, Schultz & MacDonald

(57) ABSTRACT

Machine for ground drilling, with a circulating fluid, by the utilization of electric discharge generated by high-voltage pulses between electrodes. It may comprise: —A drill-bit 1 with electrodes movable relative to each other, so that bottom-hole physical contact be secured for all the electrodes 4 on all bottom-hole topographies. —Pointed hydraulic nozzles for jetting the fluid, to remove primary cuttings and with pressure expansion across the nozzles 7 at no less than 4 MPa. —A high-voltage pulse generator deployed down-hole at a minimum distance from the drill-bit 1. —A rotating or oscillating bit causing the borehole cross-sectional excavation to occur, and electric discharge between a plurality of electrodes situated on the bit face along one or a few radii and tangents. —A bottom hole assembly for annular hole-making with core storage, transportation, down-hole closed loop discharge fluid circulation. A discharge fluid storage may be incorporated. A drilling method is also described.

58 Claims, 21 Drawing Sheets

Figure 1A:
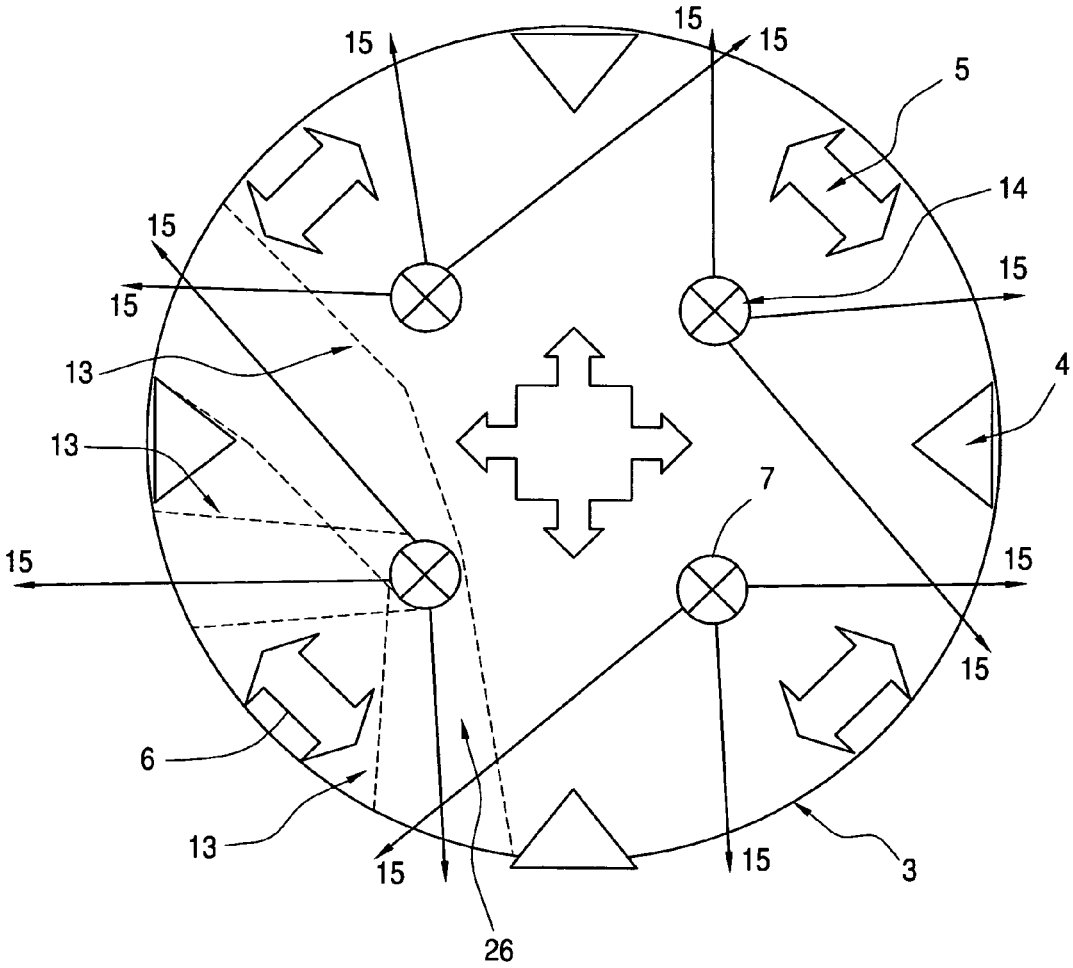

METHOD, DRILLING MACHINE, DRILL BIT AND BOTTOM HOLE ASSEMBLY FOR DRILLING BY ELECTRICAL DISCHARGE BY ELECTRICAL DISCHARGE PULSES

This application is a 371 of PCT/NO2004/000369 filed on Nov. 30, 2004.

TECHNICAL FIELD

This invention relates to plasma drilling, also called electro pulse or electro discharge method of drilling or boring holes in the ground, and the machine for such drilling or boring. In other words this invention relates to excavation of solid insulating material, mining of minerals including oil and gas, and civil engineering and construction work.

BACKGROUND ART

Excavation methods and excavators using high voltage electric pulses are previously known. For example, optimization for the crushing of a rock mass and man-made structures by means of electric pulses was described by V F Vajor et al in "Physics Vol. 4" of Tomsk Polytechnic University (Russia) 1996. Another example is by a research group at the Stratchclyde University Scotland UK 2001 where high voltage pulses were used to produce a plasma-channel formation inside the rock ahead of the drill region. The extremely rapid expansion of this plasma channel within the rock, which occurs in less than a millionth of a second, causes the local region of rock to fracture and fragment.

According to this known excavation or drilling method a drill-bit is placed on a rock mass in a discharge liquid. The drill-bit has electrodes integrated into its face. High-voltage pulses are applied to the electrodes at intervals of microseconds to allow electric discharge to pass through the rock mass so as to fracture and crush it. The time required for the rock mass to be fractured is determined by the distance between the electrodes.

Another known version of the method (U.S. Pat. No. 6,164,388) relates to the drilling of holes in the ground and incorporates the feeding of a discharge liquid into the borehole and repeated electric discharges between a plurality of pairs of electrodes which have been arrayed in a suitable arrangement on the face of the drill-bit, said discharges being generated by a stream of high-voltage pulses while at least one of three identified parameters is set at an optimum value for the minimization of the power consumption required for excavation, said parameters being i) the load voltage for the crushing of the matter to be excavated, ii) the single pulse energy and iii) the volume flow of the discharge fluid. Equations are given for the estimation of the optimum values of the parameters and it is substantiated that the optimization significantly influences the efficiency of the drilling energy consumption and progress.

The latter of these known versions of the method describes a related drilling machine consisting of a high-voltage pulse generator placed outside the borehole, a high-voltage into-the-borehole-entry arrangement, a drill-pipe and a drill-pipe guide and a drill-bit mounted at the lower end of the drill-pipe. The drill-pipe incorporates two concentric pipes separated by electric insulators, the inner constituting the high-voltage pipe and the outer the ground pipe, together axially movable within the guide in order to facilitate the drilling progress, said high-voltage pipe being electrically connected to one set of electrodes on the drill-bit and the ground pipe to another, the sets of electrodes together constituting the plurality of electrodes mentioned above. The numbers of electrodes in the two sets are not necessarily equal, but all electrodes are in a fixed arrangement relative to each other, one is in the hole centre, they move axially forward together and the only other movement incorporated is a sector rotational movement of the entire drill-bit around the axis of drilling progress.

The discharge liquid circulating system of this latter drilling machine, the liquid applied normally being diesel- or transformer oil, includes a discharge liquid reservoir, a discharge liquid pump and discharge liquid hoses and pipes. The circulating system allows the discharge liquid to circulate, passing from the reservoir, through the pump and the discharge liquid hoses and pipes to the upper end of the drill-pipe, down through the annulus between the two concentric drill-pipe sections past the insulators as well as inside the high-voltage drill-pipe section, largely freely out under the bit and up the borehole in the annulus between the ground-pipe and the wall of the borehole carrying the excavated cuttings along in the flow, and finally through a flow deflecting nipple at the top of the borehole into hoses and pipes back to the reservoir where the cuttings are separated out before the fluid is re-circulated into the borehole. Out through the bit only the internal high-voltage pipe fluid flow is subjected to directional measures, very limited and with no nozzles incorporated. The annular flow is entirely free and with its much larger cross-section leaves the former totally marginalised.

The reported methods and machines, including the drilling machine described above, which may correctly be labelled "state of the art", incorporate a number of drawbacks. The borehole external placement of the pulse generator implies the transfer of high-voltage pulses through the entire length of the borehole and the handling of high-voltage at the drill-deck where inflammable substances may occasionally be present, for example during drilling for oil and gas. The machine is thereby potentially controversial from a safety perspective and vulnerable from an insulator breakdown viewpoint for all deeper holes. The concentric twin-pipe concept with its inner annulus dictated by the insulator requirements also infringes on the cross-sectional area of the outer annulus where the cuttings are to pass through thereby increasing pressure requirements, limiting cuttings' size and potentially contributing to the stoppage of flow.

The plurality of electrodes divided in two sets, one high-voltage and one grounded, rigidly arranged relative to each other and only allowed a small sector rotation as a unit around the axis of drilling progress represents another serious drawback from the viewpoint of pulse energy application or, in other terms, pulse energy management:

Assuming a random topography at the bore-front after some drilling has occurred, it appears highly unlikely that any two electrodes will have bottom contact. One will, and whichever for a given pulse turns out to constitute the other half of the pair will, because of the rigid electrode configuration, be separated from the bottom by a smaller or larger liquid-gap thereby forcing the pulse to go off partly in liquid and partly in the bottom matrix thereby obscuring the energy efficiency and slowing down the drilling progress. The only remedy contained in the state of the art for this purpose is the sector rotation allowed, apparently assumed to facilitate a fitting through physical contact between bit and hole-bottom, but qualified judgement indicates that this at best is marginal in effect, probably of no effect at all.

The concept of plurality of electrodes in each set of electrodes contains another drawback. Understandingly it was conceived from the viewpoint of cross-sectional coverage and the reasoning that sooner or later any two electrodes of opposite charge would become the "hot" pair, thereby facilitating overall progress. It overlooked however that another occurrence will be an electrode pair of opposite charge in contact with the hole-bottom, but with such distance between them that the spark will not fly at the given pulse voltage level or it flies in liquid, thereby reducing efficiency and drilling progress.

The consistent placement in the state of the art concept of an electrode, normally a high-voltage electrode in the centre of the borehole constitutes a specific drawback. It means that no pulse discharge will ever occur there. In terms of hole-bottom topography "a mountain-top" will therefore repeatedly develop in the centre of the borehole and uphold drilling progress by the mechanisms mentioned above until it becomes unstable or for random reasons breaks off. There is reason to believe that the drilling speed of the state of the art plasma drilling in reality to a large extent is governed by such a hole-centre scenario.

Cuttings' analysis of the state of the art plasma drilling of dry, hard rock such as granite indicates that very minor physical forces are present in the drilling process, or none at all; no heat, no deformation. This gives reason to assume that the first stage of excavation after the pulse has been applied between to well-placed electrodes is a cutting or a cutting collection placed in a cavity with exact fit as the cutting, the cavity bottom and its surrounds together immediately before constituted the solid hole bottom. A serious drawback in the state of the art electro pulse drilling concept is that there are no or minimal remedies incorporated to cause the cuttings to exit from its indigenous cavity. The free flow of discharge liquid axially from under the bit is the only remedy. Compared to other drilling practices and the hydraulic energy utilized there in order to remove much less dug-in cuttings it would appear totally inadequate. There are therefore reasons to assume that cuttings in state of the art electro discharge drilling remain in place for a substantial time after broken loose and that they receive repeated pulse discharges thereby breaking into smaller pieces before they are finally exited from the bottom of the hole. Lack of efficiency in bottom hole cleaning is widely known from drilling practices in general as a major cause of reduced drilling progress. These practices commonly apply mechanical means to facilitate the cleaning, in addition to the hydraulic; scraping, cutting and hammering.

The annular hydraulic lifting of cuttings requires circulating fluid velocities and viscosities that have been substantiated through many generations of drilling practise. For large cuttings and dry hard rock of high density such as granite, the requirements are at their maximum. The use of pure transformer or diesel oil as a discharge fluid puts the state of the art electro discharge drilling technology at a significant distance from these requirements. In order to conform, the viscosity must be increased and the flow regime maintained at higher pressure differentials than currently used. Likelihood is that the state of the art technology after repeated cuttings breakage moves the cuttings to the periphery of the bit from where it sets up a temporary flow-loop a short distance up the annulus until a slug has been built up at which time it travels up and emerges in the form of slug flow. This is another facet of inadequate bottom hole cleaning which constitutes a serious drawback by slowing the drilling speed.

In GB patent specification (Tylko 1966) arc plasma is used as a heat source and the circulation liquid has a quenching function in addition to the removal of residues, i.e. the cuttings, of the drilling. Arc plasma drilling has never been successful in high speed operations.

OBJECTS OF THE INVENTION

It is in view of the drawbacks incorporated in the prior art as described above that the present invention has been made. It is the object of the present invention to provide a hitherto undisclosed drilling assembly based on the electro pulse drilling concept, with capability to drill significantly faster and more efficient than before.

DISCLOSURE OF THE INVENTION

The main features of the invention is described in claim 1. Further features and modifications are described in the subclaims.

The present invention provides an excavation machine based on the electro pulse concept for the excavation of any kind of rock material or man-made material of similar kind, in the form of hole-making, in the following called drilling; vertically, slanted or horizontally or any combination thereof, and of any diameter or length, said electro pulse concept incorporating the circulation of a discharge fluid and the availability at the hole-bottom of high voltage pulses at a high frequency and with sufficient pulse energy to break the subject material. The definitions of high frequency, high voltage and sufficient energy all refer to material disclosed before, typically 1-20 Hz frequency, 250-400 KV and 1-5 KJ, but not necessarily confined to these value ranges.

A detail incorporated in the invention is an electro-pulse drill-bit with novel features in the form of electrodes which will always be in contact with the hole-bottom and which are numbered, arranged and manipulated in such manner that the hole-bottom is systematically excavated including borehole directional control and steering, said drill-bit excavating the full cross-section of the borehole or only a ring-shape cross-section.

The invention furthermore incorporates the concept of a bottom hole pulse generator or a plurality of such generators by which is facilitated a much reduced transfer distance for the high voltage pulses and a safe voltage level for the energy transfer through the bore-hole and at the surface.

A novelty of the invention is also the hydraulic energy interaction in the drilling process, consisting of a circulation loop for discharge fluid under high pressure to flow from a pump, said pump in one form of the invention being located down-hole and in another at the surface and connected to the drill-bit by suitable pipes or hoses, through nozzles incorporated in the drill-bit, said nozzles having novel placement and direction for the purpose of cuttings removal from under the bit, thereby cleaning the hole bottom efficiently, said circulation loop finally incorporating return flow through the annular space around the drill-bit back to a discharge fluid cleaning and cuttings removal and storage system, which in one form of the invention is located down-hole and in another at the surface and from which the fluid is re-circulated in the borehole after cleaning, said cuttings removal system in the form when a ring-shape cross-section is cut, also incorporates a cutting and hoisting arrangement for the remaining cylindrical volume of cuttings which is left as a core in the borehole after the ring has been cut, to be hoisted to the surface in one piece.

The invention finally incorporates an electro-pulse drill-bit configuration with integrated means for mechanical interaction in the excavation and excavated material, herein called cuttings removal process through the application of physical contact and motion, rotational, axial or other, or combinations thereof, by scraping, cutting, hammering or similar devices mounted on the drill-bit boss.

The invention in one embodiment, hereafter called embodiment "A", incorporates a plurality of electrodes consisting of two sets of electrodes, one high-voltage and one grounded, the electrodes in each set similar in number and positioned according to the same principles as in the prior art described above for full borehole cross-sectional excavation, but with a different electrode design. Each electrode, or each except one, is allowed a limited freedom of movement, said movement being or as a minimum having a component of the movement along or in parallel with an axis defined by the direction of drilling. A bit of this kind being lowered on to the hole-bottom will hit it firstly by an electrode residing in its fully-forward-moved position, then as weight is applied on the bit this electrode is pushed backwards, other electrodes also in their fully-forward-moved positions then hit the hole-bottom until, in the all-electrode movable case, one has been pushed into its fully retracted position or, in the all-but-one-electrode movable case, the fixed electrode hits the hole-bottom. At this moment the different electrodes will be individually positioned relative to their fully retracted or fully-pushed forward positions. All electrodes will have bottom contact, and this will always remain so as long as the maximum relief of the hole-bottom topography remains roughly within the stroke length of the electrodes. The difference between the all-moveable and all-but-one-moveable electrodes embodiments is on behalf of the latter, that the weight on the bit will always rest on one identified spot, given correct design of the stroke-length and -position of the electrodes.

Such movement could be facilitated by mounting each electrode like a plunger in a cylinder with the cylinder fixed on the drill-bit boss and the electrode cum plunger pushed forward by a helical spring situated inside the cylinder, by hydraulic pressure applied in the cylinder behind the electrode, or by a combination of the two principles, or by any other similar measure. In the hydraulic version the electrode could be configured so that pressure could be applied to both sides of it thereby allowing for the electrode to act like a piston with forced movement both forward, in the direction of drilling, and in the opposite direction, hereafter called backward. Or the movement could be facilitated by mounting each electrode on an arm which would be hinged on the drill-bit boss and forced to move in the manners and by means as exemplified above though in this case it should be understood that only a component of the movement would be in the axial direction, or the movement of the electrodes could be by a combination of the two principles or any other principle or combination of principles.

Given a hole-bottom topography with arbitrary troughs and crests, the bottom hole electrode contact might conceivably in many cases be obtained also in the absence of axial movement, by a combination of tangential and radial movement, therefore in principal this is also included in the practical applications' domain of the invention.

The primary purpose of the freedom of the forward limited axial movement of each electrode would be to secure for each electrode to have bottom contact at all times. Operationally as the sum of the forces pushing the electrodes forward would tend to lift the drill-bit off the bottom a weight on the bit should be facilitated, ordinarily by the gravity force of the drilling assembly, but not necessarily so, such weight on the bit to exceed said sum of forces in order that the resting of the bit on the bottom be secured. The scenario of the hole-bottom contact according to this concept, hereafter called embodiment "A1" would thus imply a minimum of one electrode in the fully retracted bottom position in its cylinders, said electrode(s) carrying more than its (their) prorated portion of the weight on the bit, and another number of electrodes more or less moved forward in their cylinders according to the movement allowed by the topography of the hole-bottom, these electrodes carrying less than their prorated portion of the weight on the bit.

Alternatively, one electrode could be fixed with no movement allowed relative to the drill-bit boss. The running mode in this case, hereafter called embodiment "A2", would be to let this electrode define the bit-position above the hole-bottom and all the other electrodes to achieve their bottom contact by forward movement in their cylinders as allowed by the hole-bottom topography.

Operating in this manner would effectively secure contact between hole-bottom and all the electrodes provided that the limited axial movement hereafter called the stroke length of each electrode exceed the axial relief of the topography of the hole-bottom and, in the case of the all-but-one-moveable electrodes embodiment, have correct placement relative to the fixed electrode. Said relief might be estimated based on the estimated size of cuttings; in electro pulse drilling recognized as a function of the distance between electrodes, thereby laying the basis for a sufficient stroke length to be incorporated for all-time contact of all electrodes.

Such hole-bottom contact of all electrodes at all times would imply that all electrode gaps, electrically coupled in parallel, would constitute circuit elements of equal or near equal resistance at all times thereby allowing for a larger electric charge to pass and requiring a pulse energy supply larger than before. Given such supply this new drill-bit could facilitate a drilling speed increased from the speed experienced before by a factor in magnitude of the same order as the increase in pulse energy supply.

In the form incorporating two-way hydraulic electrode control as described above the new electro pulse drill-bit invention incorporates the possibility of electrode active-gap control, hereafter called embodiment "A3".

In the form incorporating two-way hydraulic electrode control as described above, the novel electro pulse drill-bit incorporates the possibility of electrode active-gap control, hereafter called "A3". In one mode of operation all but one electrode pair of the A3-configuration in one moment or one short time-span might be retracted causing bottom contact to occur only by said pair and one pulse or one train of pulses of predetermined length thereby to go off at a predetermined place on the hole-bottom, said pair of electrodes being exchanged in favour of another pair before the next pulse or train of pulses goes off, for example but not necessarily a neighbouring pair, and thus by sequential hydraulic manipulation of the electrodes as governed by computer control or similar means, systematically exchange the active pair until the entire hole-bottom has been swept by electro pulses, much in the same manner as a rotating bit, though in this case the bit would be rotationally at rest. The train length would be decided by the estimated number of pulses needed to break loose a primary cutting. This mode of operation would require no more pulse energy than before, yet be secured full bottom hole contact by both electrodes and thus have potential for great improvement in drilling efficiency over the prior art, and with pulse energy equally applied over the entire bottom hole cross-sectional area have full directional stability.

In the case of a bit with one fixed electrode as described above (A2), in order to facilitate directional stability this electrode would have to be the centre electrode. Designating any other electrode as the fixed electrode would cause a drill-string bending moment to be set up by the weight on the bit acting down and its counter-force acting up and this moment would cause the direction of drilling to deviate away from its previous direction causing a curved trajectory to develop. The matter could be constructively used in combination with the bit-concept with all electrodes moveable by double-acting hydraulic pistons as described above (A3). One off-centre electrode could be hydraulically locked in position to serve as the fixed electrode, thereby causing a curved trajectory to develop in a desired direction, or in a case when directional stability has been impaired, cause the intended direction of drilling to be restored.

When an electric pulse as specified above ignites between two electrodes submerged in a proper discharge fluid and in contact with the hole-bottom probability is that a cutting is formed, herein called a primary cutting, along with some fragmented hole-bottom material. The primary cutting from prior art is rather well defined in size and shape, the length equal to 0.6-0.8 S, the width 0.3-0.5 S and the thickness 0.2-0.3 S where S is the light-opening between electrodes and with an oval cross-section when cut along the thickness-axis though the edges are not much rounded.

In the preparatory work for this invention one has been aware that electro-pulse drilling efficiency very much depends on the immediate removal of the primary cutting from the cavity where it inherently belonged, to the periphery of the hole-bottom cross-sectional area and from there up the borehole annulus. The corresponding priority direction of cuttings movement from the bit is generally radial in the borehole. This direction of movement applies directly for primary cuttings from tangentially oriented electrode gaps positioned at the outer periphery of the bit boss. In the case of radially oriented electrode gaps, or gaps with any other orientation, this general priority direction is compromised in favor of a revised priority direction for primary cuttings' movement out from under the bit, angled from the radial direction enough to allow the cutting a straight-line passage through the first neighbouring tangential electrode gap as seen from the borehole center in the direction of the periphery or the first neighbouring group of electrode gaps as the specific electrode configuration may require, or as near to a straight-line passage as possible through said electrode gaps. In the case of the concept "A3", the added priority exists that the priority direction of cuttings' movement should be away from the next active electrode gap.

In general terms applicable for all electrode gaps, radial, tangential or otherwise directed, the vector direction of movement for the primary cuttings should be as close as possible to right-angled to the connecting line between the electrodes where it originated, away from the next active electrode gap if relevant; nevertheless compromised sufficiently and yet as little as possible in order to define a straight-line path to the periphery with a minimal danger or no danger at all of blockage by other electrodes.

The invention incorporates a drill-bit boss made of an electrically isolating material such as a ceramic compound, epoxy or similar material from which the electrodes protrude a minimal distance and in which are incorporated bored channels for discharge fluid flow, said channels having an exit configuration which allows for separate and exchangeable nozzles to be inserted, and nozzle exit placement and direction specific for each electrode gap so as to facilitate an as accurate as possible hit by the hydraulic nozzle jet into the crack which is developed whenever a primary cutting is broken loose, said hit or jet-impact having direction parallel to the surface of the primary cutting where the jet hits or as near as possible to such parallel direction and said hit also having a major component of its vector direction along the priority direction of cuttings' movement for that particular electrode gap. A feature of the invention is also that the hydraulic pressure expanded through the nozzles should be as high as practically possible and no less than 4 MPa, the exact value decided by the selected nozzle diameter based on the relevant volume flow. The invention also incorporates open channels cut out on the face of the bit boss, said channels having wide enough cross-sectional area to allow for the primary cuttings to move through and direction corresponding to the priority direction of cuttings' movement.

Prior art has employed the concept of a pulse generator of the well-known Marx scheme with electric pulse energy storage, or the particle accelerator-type scheme, with magnetic pulse energy storage, such generators, generally with input at 1 KVAC-level being deployed externally to the borehole with pulse transfer at full voltage level trough its entire length. The transfer through the entire borehole of electric pulses of the indicated voltage and energy level implies very strict confinement on drill-string design and a high risk of failure, said restrictions being to some extent contrary to other design requirements. Confinements exemplified are the necessity of a high-voltage string; pipe, cable or otherwise, and there has to be a ground-string of similar configuration and the two must be separated by a multitude of isolators and through-out the borehole maintain a distance between them of magnitude similar to the electrode gap S.

The individual electric pulse from prior art is known to have a duration=10 μS. Within the operating frequencies indicated there is consequently time for two or more pulse generators to work in parallel, each feeding their dedicated electrode gaps, or in series feeding the same electrode gap or group of gaps, all pulse energies being transferred from generator to electrode gap by the same conduits through a switching arrangement.

The invention incorporates an electric pulse generator of known electric configuration, such as the electric or magnetic storage scheme with input at the 1KVAC- or other practical level, configured to comply with the restrictions of down-hole deployment, such as the hole diameter and the passage of discharge fluid, and meet the request for down-hole mechanical and thermal strength and other requirements, said down-hole pulse generator consisting of one single pulse generator or a plurality of pulse generators, such plurality of generators having pulses spaced from each other in time and through a switching arrangement working in parallel each on its dedicated electrode gap or group of electrode gaps, or working in series on the same electrode gap or group of electrode gaps, and such generator or plurality of generators being incorporated in the drill-string immediately behind the bit or as a minimum near the bit so as to make the pulse transfer conduits as short as possible and independent of the borehole depth while the energy transfer through the entire length of the borehole is at the 1KVAC- or other practical level.

In the form described above (Embodiment "A") the invention is applied as part of an overall drilling machine with the circulating pump situated at the surface and connected, hydraulically and mechanically to the down-hole pulse generator or generators and drill-bit by a drill-string consisting of a suitable pipe, hose or combination of pipes and hoses, said drill-string itself serving as a conduit or having integrated in it a conduit such as a cable for the transfer of adequate electric energy at 1KVAC- or other practical voltage level, said drill-bit excavating the full cross-sectional area of the borehole and the cuttings being circulated back to the surface and removed from the discharge fluid there before the discharge fluid is thereafter re-circulated in the borehole.

A further feature of the invention, hereafter called embodiment "B", incorporates a bit boss with enforced rotational movement and a plurality of electrodes positioned on the front of the bit boss so as to form one line, straight, curved or broken, two such lines or a plurality of such lines. The embodiment "B" incorporates one such line extending from periphery to periphery on the face of the bit boss, but not necessarily having its end points at the periphery, and intersecting the center of the boss though not with an electrode placed at the centre, said electrodes further consisting of two sets of electrodes, one high-voltage and one grounded, the electrodes in each set positioned so that the nearest electrode or electrodes are always of opposite polarity, said line configuration and electrode positioning to facilitate at least one electrode gap to travel across any cross-sectional unit area of the hole-bottom per rotation of the bit boss thereby providing full borehole cross-sectional excavation, said electrodes or all but one to be allowed a limited freedom of movement relative to the bit boss, said movement being or as a minimum having a component of the movement along or in parallel with an axis defined by the direction of drilling.

According to one feature of the embodiment "B", which is suitable for smaller boreholes, the radially oriented electrode-gaps are situated along two opposing radii, one electrode placed at the periphery of one radius, the next near the centre on the same radius and the third on the opposing radius at a distance S from the second corresponding to the distance S between the first two, then one electrode on the periphery a distance S from the first electrode in the direction opposite of the rotational direction and finally one electrode on the periphery a distance S from the third in the direction opposite of the rotational direction, the five electrodes jointly forming a pattern roughly similar to the S as seen from a position under the bit and given counter-clockwise rotational direction, said electrodes of the preferred embodiment further consisting of two sets of electrodes, one high-voltage and one grounded, the electrodes in each set positioned so that the neighbouring electrode or electrodes are consistently of opposite polarity, said line configuration and electrode positioning to facilitate a minimum of one electrode gap to travel across any cross-sectional unit area of the hole-bottom per revolution of the bit boss as the electrodes positioned radially on one radius follow circular patterns around the centre different from the circular patterns followed by the electrodes on the other radius thus providing full borehole cross-sectional excavation including borehole centre excavation, said electrodes or all, but one to be allowed a limited axial freedom of movement as described above, said movement being or as a minimum having a component of its movement in parallel with an axis defined by the direction of drilling.

In practical terms, such movement could be facilitated by mounting each electrode like a plunger in a cylinder with the cylinder fixed on the drill-bit boss and the electrode pushed forward by a helical spring situated inside the cylinder, by hydraulic pressure applied in the cylinder behind the electrode, or by a combination of the two principles, or by any other similar measure. In the hydraulic version the electrode could be configured so that pressure could be applied to both sides of it thereby allowing for the electrode to act like a piston with forced movement both forward, in the direction of drilling, and backward. Or the movement could be facilitated by mounting each electrode on an arm which would be hinged on the drill-bit boss and forced to move in the manners and by means as exemplified above though in this case it should be understood that only a component of the movement would be in the axial direction, or the movement of the electrodes could be by a combination of the two principles or any other principle or combination of principles.

By choosing different combinations of pulse frequency and rotational speed this configuration of five electrode-gaps, or more if the diameter so requires, could be made to cover the entire hole-bottom at different discharge intensities. For example, given a pulse frequency of 16 Hz in combination with 30 RPM in a 20 cm diameter borehole with tangential electrode-gap S=8 cm, the peripheral or tangential electrode displacement would be exactly 1 S per pulse; at 60 RPM it would be ½ S thereby doubling the energy discharged per unit area. With no electrode in the centre and the middle electrode on each radius at different distances from the centre no unit area would be left without regular coverage in the form of being incorporated in an active electrode-gap.

The primary purpose of the freedom of the forward limited axial movement of each electrode would be to secure for each electrode to have permanent bottom physical contact in the borehole. Operationally, as the sum of the forces pushing the electrodes forward, would tend to lift the drill-bit off the bottom, a weight on the bit should be facilitated, ordinarily by the gravity force of the drilling assembly, but not necessarily so, such weight on the bit is provided to exceed said sum of forces in order to push the bit against the bottom. The scenario of the hole-bottom contact according to this concept, hereafter called B1 would thus imply a minimum of one electrode in the fully retracted bottom position in its cylinder, said electrode(s) carrying more than its (their) prorated portion of the weight on the bit, and another number of electrodes more or less moved forward in their cylinders according to the movement allowed by the topography of the hole-bottom, these electrodes carrying less than their prorated portion of the weight on the bit, said position of electrode relative to cylinder shifting among the electrodes from moment to moment according to the rotation and topography of the hole-bottom.

Alternatively, one electrode could be fixed with no movement allowed relative to the drill-bit boss. The running mode in this case, hereafter called embodiment "B2", would be to let this electrode define the bit-position above the hole-bottom and all the other electrodes to achieve their bottom contact by forward movement in their cylinders as allowed by the hole-bottom topography and the rotation.

Operating in this manner would effectively secure contact between hole-bottom and all the electrodes provided that the limited axial movement, herein called the stroke length of each electrode, exceeds the axial relief of the topography of the hole-bottom and, in the case of the all-but-one-moveable electrodes embodiment, have correct placement relative to the fixed electrode. Said relief might be estimated based on the estimated size of cuttings; in electro pulse drilling recognized as a function of the distance between electrodes, thereby providing the basis for a sufficient stroke length to be incorporated for all-time contact of all electrodes.

Alternatively, all electrodes could be fixed, hereafter called embodiment "B3", said configuration being relevant as its low number of electrodes would cause bottom hole contact in general to be less infrequent compared to the prior art.

In the embodiment incorporating two-way hydraulic electrode control as described above, the invention incorporates the possibility of electrode gap control, hereafter called embodiment "B4". In one mode of operation, all but one electrode pair of the embodiment "B4", in one moment or one short time-span might be retracted causing bottom contact to occur only by said pair and one pulse thereby to be released at a predetermined place on the hole-bottom, said pair of electrodes being exchanged in favour of another pair before the next pulse goes off, for example but not necessarily a neighbouring pair, and thus by sequential hydraulic manipulation of the electrodes as governed by computer control or similar means, systematically exchange the active pair until the entire hole-bottom has been swept by electro pulses, said exchange to be coordinated with the rotation so that adequate coverage of active electrode-gaps across the hole-bottom be facilitated. This mode of operation would require no more pulse energy than before, yet be secured full bottom hole contact by both electrodes and thus have potential for great improvement in drilling efficiency over the prior art, and with pulse energy equally applied over the entire bottom hole cross-section have full directional stability.

The gap control of the embodiment "B4" could used in an operating mode where one off-centre electrode was hydraulically locked in position to serve as the fixed electrode, the computer control in this case allowing for the electrode axial lock to switch from one electrode to another as they rotate so as to cause the locked electrode to appear on a fixed radius on the bore-hole bottom, thereby causing a fixed or near fixed bending moment to be maintained in the drill-string and a curved trajectory to develop steadily in a desired direction, or in a case when directional stability has been impaired, cause the intended direction of drilling to be restored.

The invention defines a priority direction of cuttings transport from the bit, said transport originating at the cavity created when a primary cutting as defined above is released, but not lifted from its inherent place as an integrated part of the bottom matrix, and remedies for the immediate removal of the primary cutting from its inherent place to the periphery of the hole-bottom cross-sectional area and from there up the borehole annulus, said direction of cuttings movement being generally radial in the borehole. Said radial direction of movement applies directly for primary cuttings from tangentially oriented electrode gaps positioned at the outer periphery of the bit boss. In the case of radially oriented electrode gaps, or gaps with any other orientation, this general priority direction is compromised in favour of a revised priority direction, angled from the radial direction in the direction opposite to the rotation and enough to allow the cutting a straight-line passage through the first neighbouring tangential electrode gap as seen from the borehole centre in the direction of the periphery or the first neighbouring group of electrode gaps as the specific electrode configuration may require, or as near to a straight-line passage as possible through said electrode gaps.

In general terms applicable for all electrode-gaps orientation, radial, tangential or otherwise directed, the vector direction of movement for the primary cuttings should be as close as possible to right-angled to the connecting line between the electrodes where it originated, away from the next active electrode gap or opposite to the direction of rotation as may be relevant; nevertheless compromised sufficiently and yet as little as possible in order to define a straight-line path to the periphery, such path selected from the viewpoint of a minimal danger or no danger at all of blockage by other electrodes.

The embodiment "B" incorporates a drill-bit boss with integrated means for mechanical interaction in the excavation and excavated material's, herein called cuttings' removal process through the application of physical contact and motion, rotational, axial or other, or combinations thereof, by scraping, cutting, hammering or similar actions by devices mounted on the drill-bit boss.

The invention incorporates a drill-bit boss to be made of an electrically isolating material, such as ceramic compound, epoxy or similar material from the face of which the electrodes protrude a minimal distance and in which are incorporated bored channels for discharge fluid flow, said channels having an exit configuration which allows for separate and exchangeable nozzles to be inserted, and nozzle exit placement and direction specific for each electrode gap so as to facilitate an as accurate as possible hit by the hydraulic nozzle jet into the crack which is developed whenever a primary cutting is broken loose, said hit or jet-impact having direction parallel to the surface of the primary cutting where the jet hits or as near as possible to such parallel direction and said hit also having a major component of its vector direction along the priority direction of cuttings' movement for that particular electrode gap. Specified according to the invention is also that the hydraulic pressure expanded through the nozzles should be as high as practically possible and no less than 4 MPa, the exact value decided by the selected nozzle diameter based on the relevant volume flow. The invention also incorporates open channels or grooves cut out on the face of the bit boss, said grooves having a wide enough cross-sectional area to allow for the primary cuttings to move through and direction corresponding to the priority direction of cuttings' movement.

The invention incorporates an electric pulse generator of known electric configuration, such as the electric or magnetic storage scheme, with input at the 1KVAC- or other practical level as described above, configured so as to comply with the restrictions of down-hole deployment such as the hole diameter and the passage of discharge fluid, and meet with the down-hole mechanical and thermal strength and other requirements, said down-hole pulse generator consisting of one single pulse generator or a plurality of pulse generators, such plurality of generators having pulses spaced from each other in time and through a switching arrangement working in parallel each on its dedicated electrode gap or group of electrode gaps, or working in series on the same electrode gap or group of electrode gaps, and such generator or plurality of generators being incorporated in the drill-string immediately behind the bit or as a minimum near the bit so as to make the pulse transfer conduits as short as possible and independent of the borehole depth while the energy transfer through the entire length of the borehole is at the 1KVAC- or other practical level.

The embodiment "B" incorporates an overall drilling system configuration with drill-bit rotation said rotation caused by a rotational motor placed at the surface or in the borehole. In one preferred feature of the invention according to embodiment "B", the rotational motor is incorporated in the drill-string near the bit, above or below the pulse generator said rotational motor being electrically or hydraulically powered with sufficient power to rotate the bit at any speed up to 1000 RPM, the actual rotational speed selected according to the actual purpose and conditions. The invention also incorporates a circulating pump situated at the surface and connected, hydraulically and mechanically, to the down-hole pulse generator or generators, the motor if applicable and the drill-bit by a drill-string consisting of a suitable pipe, hose or combination of pipes and hoses, said drill-string itself serving as a conduit or having integrated in it a conduit such as a cable for the transfer of adequate electric energy at 1KVAC- or other practical voltage level, said pump causing the discharge fluid to flow down through the drill-string, exit through the nozzles incorporated in the bit and back to the surface through the annulus surrounding the drill-string carrying the cuttings with it back to the surface where they are removed from the discharge fluid before the clean fluid is returned to the pump for re-circulation.

An embodiment "C" of the invention incorporates two electrodes or a plurality of electrodes constituting two sets of electrodes, one high voltage and one grounded, the electrodes in each set similar though not necessarily identical in number thereby constituting pairs of electrodes, each pair positioned so that their connecting line will have a tangential orientation as mounted on a drill-bit boss, said drill-bit boss having a ring-shaped cross-sectional area with a small radial extension, in one preferred embodiment with said radial extension at the minimum required by the presence of electrodes and discharge fluid nozzles on its surface. In this embodiment, each electrode or each but one electrode is allowed a limited freedom of movement relative to the its boss, said movement having at least a component of the movement in parallel with the direction of drilling.

Such movement could be facilitated by mounting each electrode like a plunger in a cylinder with the cylinder fixed on the drill-bit boss and the electrode or plunger pushed forward by a helical spring situated inside the cylinder, by hydraulic pressure applied in the cylinder behind the electrode, by a combination of the two principles or by any other similar measure. In the hydraulic version the electrode could be configured so that pressure could be applied to both sides of it thereby allowing for the electrode to act like a piston with forced movement both forward, in the direction of drilling, and backward. Or the movement could be facilitated by mounting each electrode on an arm which would be hinged on the drill-bit boss and forced to move in the manners and by means as exemplified above though in this case it should be understood that only a component of the movement would be in the axial direction, or the movement of the electrodes could be by a combination of the two principles or any other principle or combination of principles. The primary purpose of the freedom of the forward limited axial movement of each electrode would be to secure for each electrode to have bottom contact at all times.

An embodiment "C1" incorporates a ring-shaped bit boss with enforced rotational movement and only one pair of electrodes, of which one may be fixed, hereafter called embodiment "C 1F". In another embodiment, hereafter called "C2", it incorporates a ring-shaped bit boss with enforced rotational movement and two electrode pairs positioned opposite each other on the bit boss, as an alternative with one electrode fixed, then called embodiment "C2F". In other embodiments, hereafter called "C3, C4, C5 . . . Cn", the invention incorporates a ring-shaped bit boss with enforced rotational movement and 3, 4, 5 and more pairs of electrodes of which one electrode may be fixed, then called "C3F, C4F, C5F" etc, each pair separate from the other pairs or with one common electrode, and said enforced rotational movement to apply but in the embodiment Cn when the boss have evenly spaced electrodes around its entire circumference and said rotational movement being in the form of a fixed rotational direction or in the form of oscillations.

As the sum of the forces pushing the electrodes forward would tend to lift the drill-bit off the bottom, a weight on the bit should be facilitated, ordinarily by the gravity force of the drilling assembly, but not necessarily so. Such weight on the bit should exceed said sum of forces in order that the resting of the bit on the bottom is secured.

The scenario of the hole-bottom contact according to these embodiments would thus for the embodiments "C1 and C1F" imply one electrode in bottom position in its cylinder (embodiment "C1") or the bit boss position above the hole-bottom defined by the fixed electrode (embodiment "C1F") and the other electrode more or less moved forward in its cylinder according to the movement allowed by the topography of the hole-bottom, and for the embodiments "C2 . . . Cn" imply a minimum of one electrode at any time in bottom position in its cylinder, said electrode shifting from moment to moment, or the bit boss position above the hole-bottom defined by the fixed electrode (embodiment "C2F, C3F, C4F" etc), said shifting electrode or said fixed electrode carrying more than its prorated portion of the weight on the bit, and all the other electrodes more or less moved forward in their cylinders according to the movement allowed by the rotational movement and the topography of the hole-bottom, these electrodes carrying less than their prorated portion of the weight on the bit.

Operating in this manner would effectively provide contact between hole-bottom and all the electrodes provided that the limited axial movement hereafter called the stroke length of each electrode exceed the axial relief of the topography of the hole-bottom. Said relief might be estimated based on the estimated size of cuttings; in electro pulse drilling recognized as a function of the distance between electrodes, thereby laying the basis for a sufficient stroke length to be incorporated for all-time contact of all electrodes.

Such hole-bottom contact of all electrodes at all times would imply that all electrode gaps, electrically coupled in parallel, would constitute circuit elements of equal or near equal resistance at all times, thereby allowing for a larger electric charge to pass and requiring a pulse energy supply larger than before. Given such supply this new drill-bit could facilitate a drilling speed increased from the speed experienced before by a factor in magnitude of the same order as the increase in pulse energy supply.

In the form incorporating two-way hydraulic electrode control as described above the invention incorporates the possibility of electrode active-gap control, applicable with embodiment "C" particularly but not only in the embodiments "C2 . . . Cn".

In one mode of operation all but one electrode pair of the Cn-zero-embodiment as an example in one moment or one short time-span might be retracted causing bottom contact to occur only by said pair and one pulse or one train of pulses of predetermined length thereby to go off at a predetermined place on the hole-bottom, said pair of electrodes being exchanged in favour of another pair before the next pulse or train of pulses is released, for example, but not necessarily, a neighbouring pair, and thus by sequential hydraulic manipulation of the electrodes as governed by computer control or similar means, systematically exchange the active pair until the entire hole-bottom has been swept by electro pulses, much in the same manner as a rotating bit, though in this case the bit would be rotationally at rest. The train length would be decided by the estimated number of pulses needed to break loose a primary cutting. This mode of operation would require no more pulse energy than before, yet be secured full bottom hole contact by both electrodes and thus have potential for great improvement in drilling efficiency over the prior art, and with pulse energy equally applied over the entire bottom hole cross-section have full directional stability.

In the embodiments "C2 . . . Cn" incorporating two-way hydraulic electrode control as described above the new electro pulse drill-bit invention incorporates the possibility of selective load-positioning around the periphery of the ring-shaped borehole. In the "Cn" embodiment, one electrode could be hydraulically locked in position to serve as the fixed electrode thereby causing a curved trajectory to develop in a desired direction, or in a case when directional stability has been impaired, cause the intended direction of drilling to be restored. In the "C2, C3, C4" etc embodiments, the locked electrode would be caused to switch from one to another always maintaining the locked electrode to remain in the same position on the periphery thereby causing a curved trajectory to develop in a desired direction, or in a case when directional stability has been impaired, cause the intended direction of drilling to be restored.

The invention applied with a drill-bit according to embodiment "C" leaves a core intact inside the ring. Consequently the drill-string above the bit must be configured as a core barrel, said core barrel having wall thickness as little as possible though strong enough to maintain integrity under the ruling circumstances and allowing for conduits for the transfer of signal and energy to the bit. The total length of the core barrel is decided from practical handling viewpoints, as an example 100 m which may be broken down into separate core barrel elements, for example 4 elements of 25 m length each connected together by suitable pipe connectors known from prior art.

The operational aspect of the invention in this form is for a length of an annular borehole equal to the length of the core barrel to be drilled and the core then to be cut at its base and hoisted out of the borehole, for which purpose core cutting and core gripping mechanisms must be incorporated in the barrel immediately above the bit, said core cutting mechanism for example being in the form of one or more small explosive charges incorporated in the cylindrical wall of the bit or the barrel and fired by a directed impulse, electrical, hydraulic or other, when the core is to be cut, and the core gripping mechanism for example being in the form of an inwardly expandable section of the core barrel inner wall, which is activated to expand and hold against the core after it has been freed and before hoisting begins.

When an electric pulse as specified above goes off between two electrodes submerged in a proper discharge fluid and in contact with the hole-bottom, probability is that a cutting is formed, herein called a primary cutting, with size, shape and proportions as described above and there is a dependency of the drilling efficiency on the immediate removal of said primary cutting from the cavity where it inherently belonged, to the periphery of the hole-bottom cross-sectional area and from there up the borehole annulus.

The invention, in recognition of its importance for the excavation efficiency, defines a priority direction of cuttings transport from the bit, said transport originating at the cavity created when a primary cutting as defined above is released, but not lifted from its inherent place as an integrated part of the bottom matrix, and remedies for the immediate removal of the primary cutting from its inherent place to the periphery of the hole-bottom cross-sectional area and from there up the borehole annulus, said direction of cuttings movement being generally radial in the borehole. In one particular embodiment "C", when a narrow ring permits only one radius for the electrodes to be placed on the corresponding priority direction of cuttings movement from the bit is solely outwardly radial.

In general terms applicable for all electrode-gaps orientation, radial, tangential or otherwise directed, the vector direction of movement for the primary cuttings should be as close as possible to right-angled to the connecting line between the electrodes where it originated, away from the next active electrode gap or opposite to the direction of rotation as may be relevant; nevertheless compromised sufficiently and yet as little as possible in order to define a straight-line path to the periphery or as near to a straight line passage as possible, such path selected from the viewpoint of a minimal danger or no danger at all of blockage by other electrodes.

The embodiment "C" incorporates a drill-bit boss with integrated means for mechanical interaction in the excavation and excavated material's, herein called "cuttings removal process", through the application of physical contact and motion, rotational, axial or other, or combinations thereof, of scraping, cutting, hammering or similar actions by devices mounted on the drill-bit boss.

The invention incorporates a drill-bit boss made of an electrically isolating material, such as a suitable ceramic compound, epoxy or similar material, from the face of which the electrodes protrude a minimal distance and in which are incorporated bored channels for discharge fluid flow, said channels having an exit configuration which allows for separate and exchangeable nozzles to be inserted, and nozzle exit placement along the inner periphery of the ring-shaped drill-bit at mid-position or near mid-position between any two electrodes forming an electrode pair, and nozzle direction specific for each electrode gap so as to facilitate an as accurate as possible hit by the hydraulic nozzle jet into the crack which is developed whenever a primary cutting is broken loose, said hit or jet-impact having direction parallel to the surface of the primary cutting where the jet hits or as near as possible to such parallel direction and said hit also having a major component of its vector direction along the priority direction of cuttings movement for that particular electrode gap. A further feature of the invention is that the hydraulic pressure expanded through the nozzles should be as high as practically possible and no less than 4 MPa, the exact value decided by the selected nozzle diameter based on the relevant volume flow. The invention also incorporates open channels cut out on the face of the bit boss, said channels having wide enough cross-sectional area to allow for the primary cuttings to move through and direction corresponding to the priority direction of cuttings' movement.

The invention incorporates an electric pulse generator as described above producing a continual train of pulses at the indicated level and duration, conceptually according to the electric or magnetic energy storage scheme with input at the 1KVAC- or other practical level and configured so as to comply with the restrictions of down-hole deployment, such as the hole diameter and the passage of discharge fluid and meet with the down-hole mechanical and thermal strength and other requirements, said down-hole pulse generator consisting of one single pulse generator or a plurality of pulse generators, such plurality of generators having pulses spaced from each other in time and through a switching arrangement working in parallel each on its dedicated electrode gap or group of electrode gaps, or working in series on the same electrode gap or group of electrode gaps, and such generator or plurality of generators being incorporated in the drill-string immediately above the core barrel so as to make the pulse transfer conduits as short as possible and independent of the borehole depth while the energy transfer through the entire length of the borehole is at the 1KVAC- or other practical level.

The embodiment "C" may be applied in an overall system as described before, configured with the circulating pump situated at the surface and connected, hydraulically and mechanically to the down-hole pulse generator or generators, core barrel and drill-bit by a drill-string consisting of a suitable pipe, hose or combination of pipes and hoses, said drill-string itself serving as a conduit or having integrated in it a conduit such as a cable for the transfer of adequate electric energy at 1KVAC- or other practical voltage level, and the cuttings being circulated back to the surface and removed from the discharge fluid there before the discharge fluid is thereafter re-circulated in the borehole.

A particular form of embodiment "C" is configured with the circulating pump situated down-hole immediately above the pulse generator and immediately under a cuttings' cleaning and storage unit, said latter unit consisting of a cuttings chamber with enough volume to hold the cuttings originating from a length of annular hole equal to the length of the core barrel and discharge fluid cleaning devices such as but not limited to a settling pit or a plurality of settling pits, a screen or a plurality of screens and a centrifuge or a plurality of centrifuges; all configured for down hole deployment and arranged together with the cuttings chamber, so that the annular discharge fluid with suspended cuttings flowing up the borehole is guided through the cleaning system with cuttings precipitated in the cuttings chamber and clean discharge fluid directed to the pump suction inlet.

In this preferred form of embodiment "C", the entire bottom hole drilling assembly is connected to the surface by a single steel wire rope said rope having an electric cable integrated in it for signal transfer and power transfer at a practical voltage level and the borehole is fluid filled only if formation fluid pressures or stability require it. When drilling in dry, hard rock the hole drilled with this embodiment of the invention will be fluid filled only to the top of or slightly above the cuttings chamber. In either case, the circulation will be limited to a length of borehole corresponding to the combined length of the bit and core barrel, the pulse generator or generators and the pump, and the cuttings chamber and cleaning system, said combined length estimated at 2-3 times the length of the core barrel. The energy consumption, both hydraulic and bit energy correspondingly will be greatly reduced compared to full profile borehole drilling with circulation back to the surface.

EXAMPLES

Figure 1B:
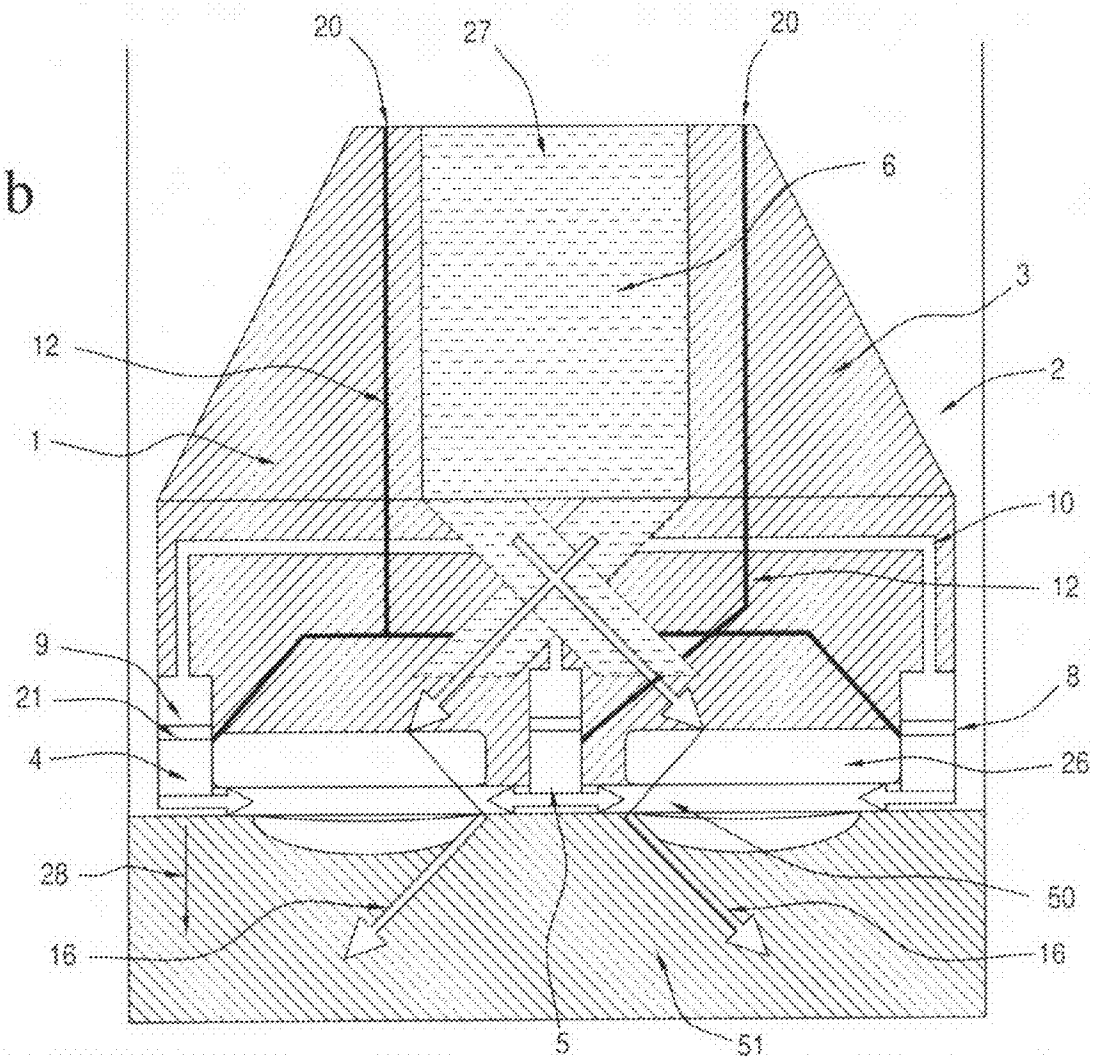
Figure 2A:
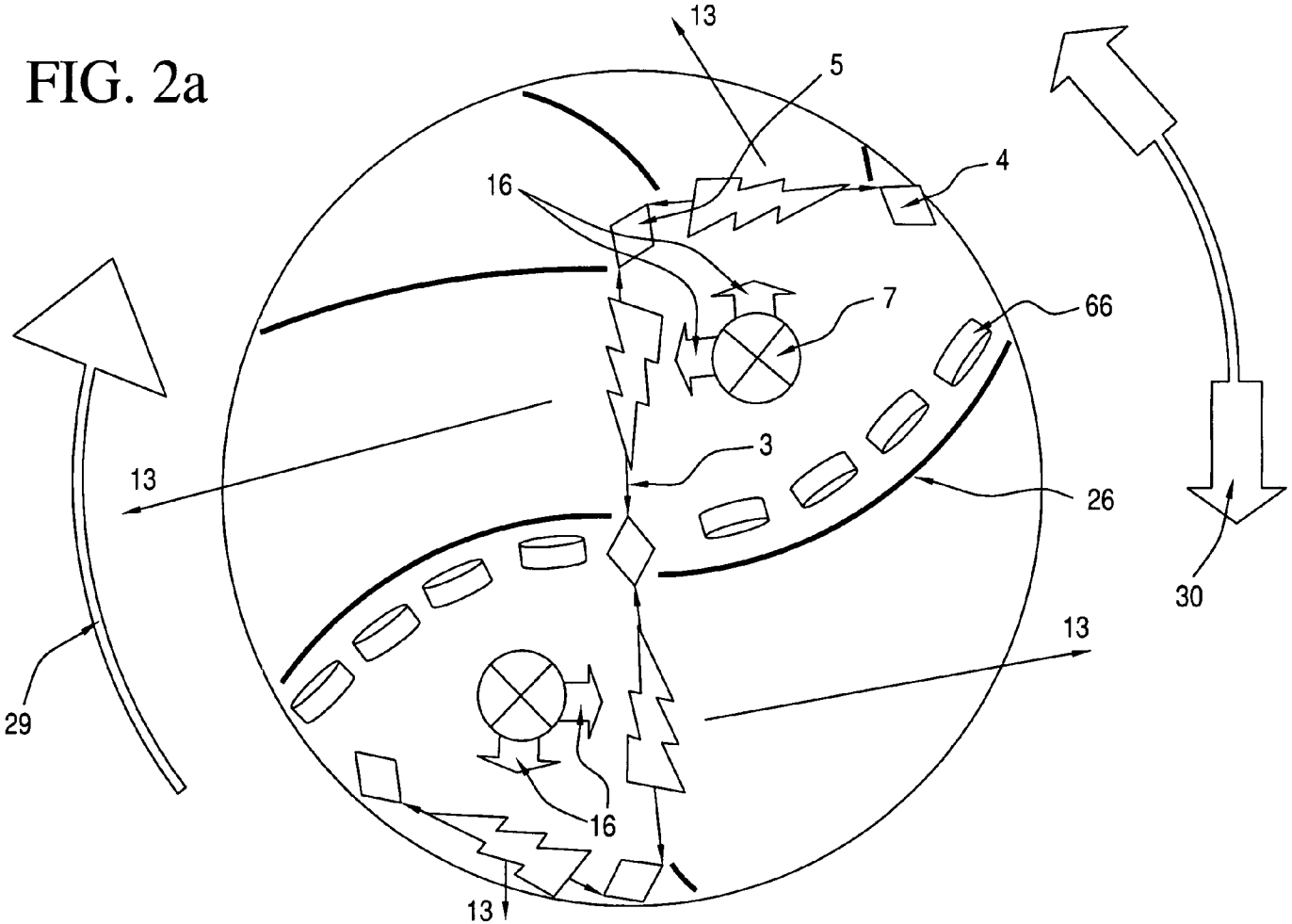
Figure 2B:
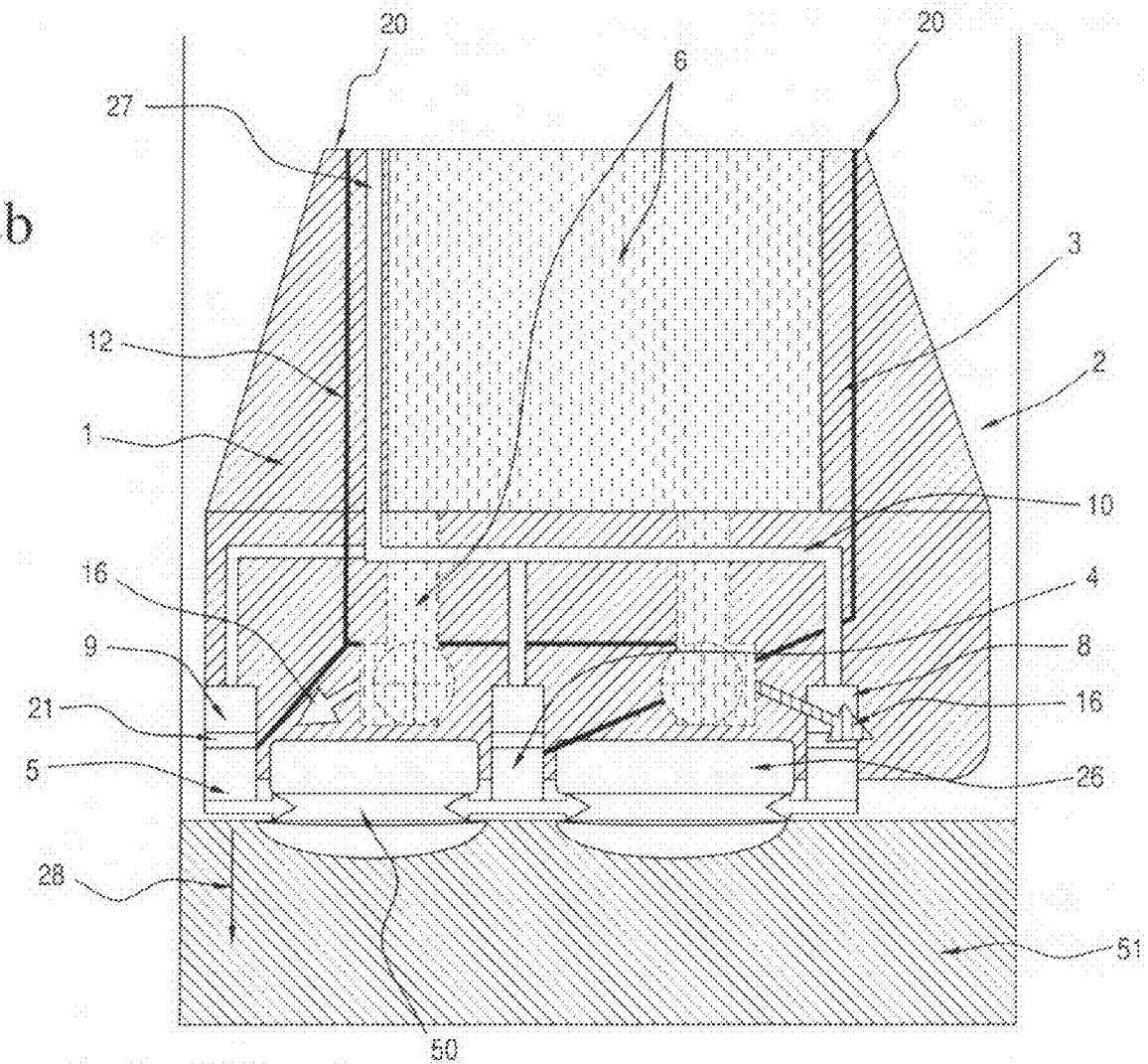
Figure 2C:
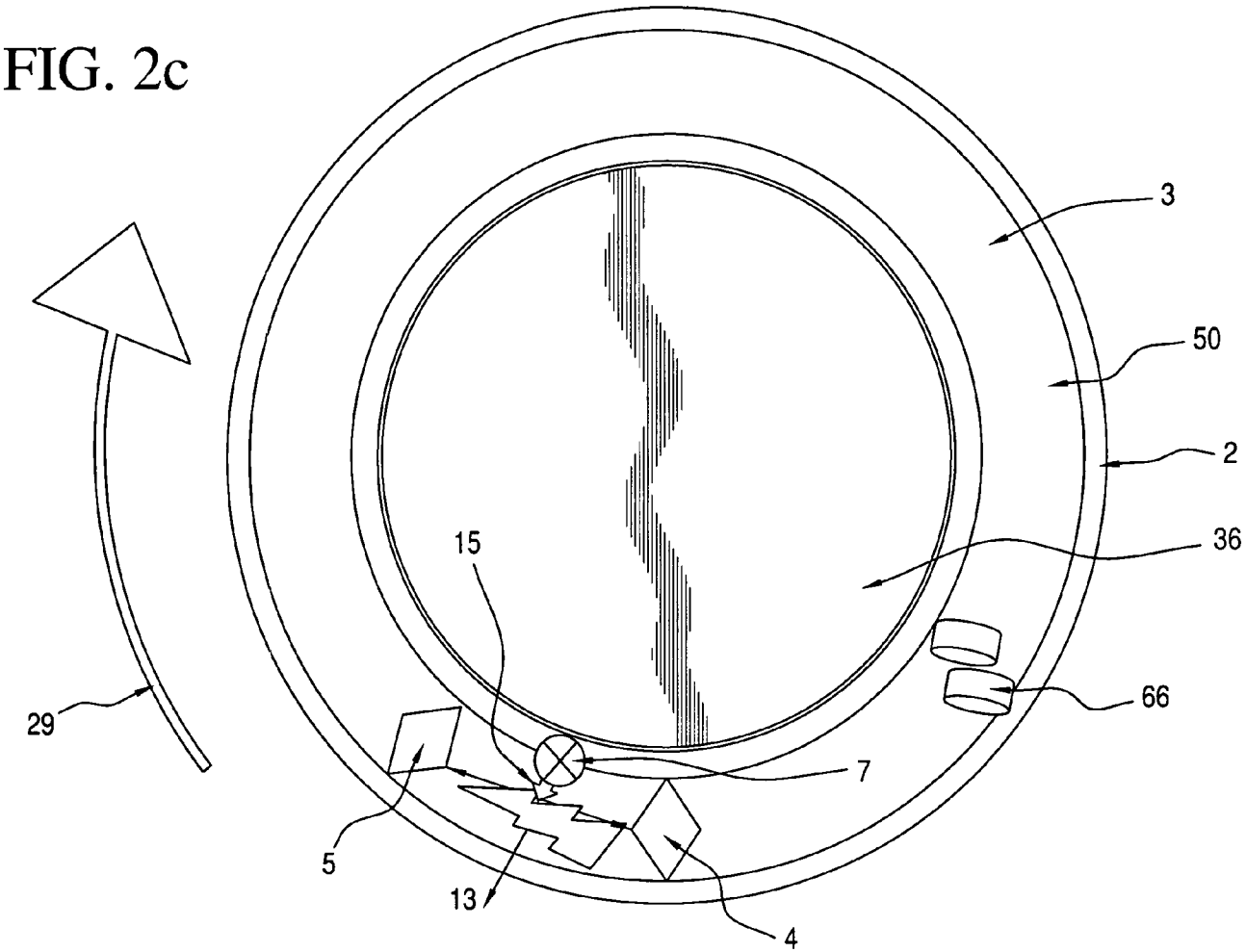
Figure 2D:
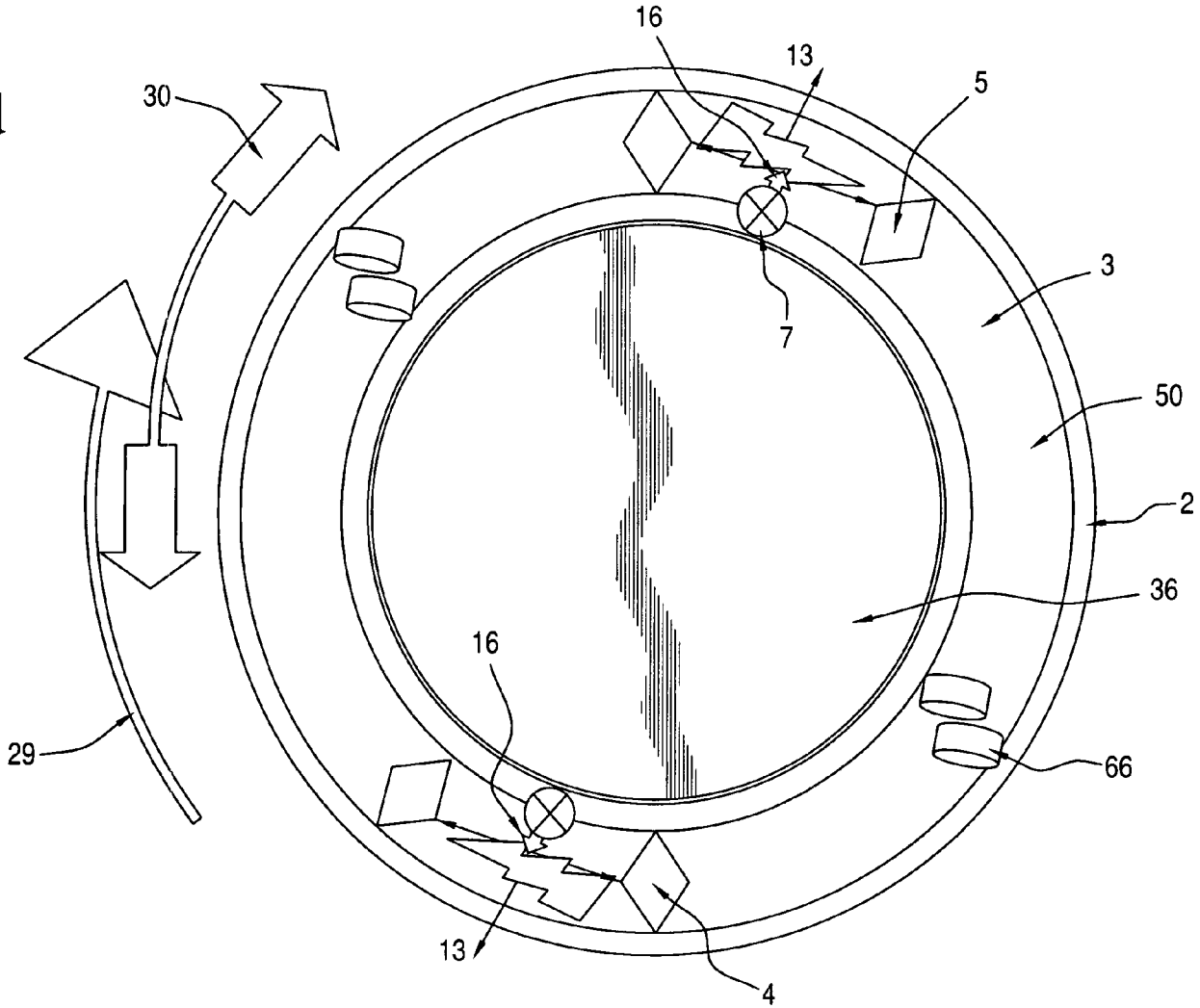
Figure 2E:
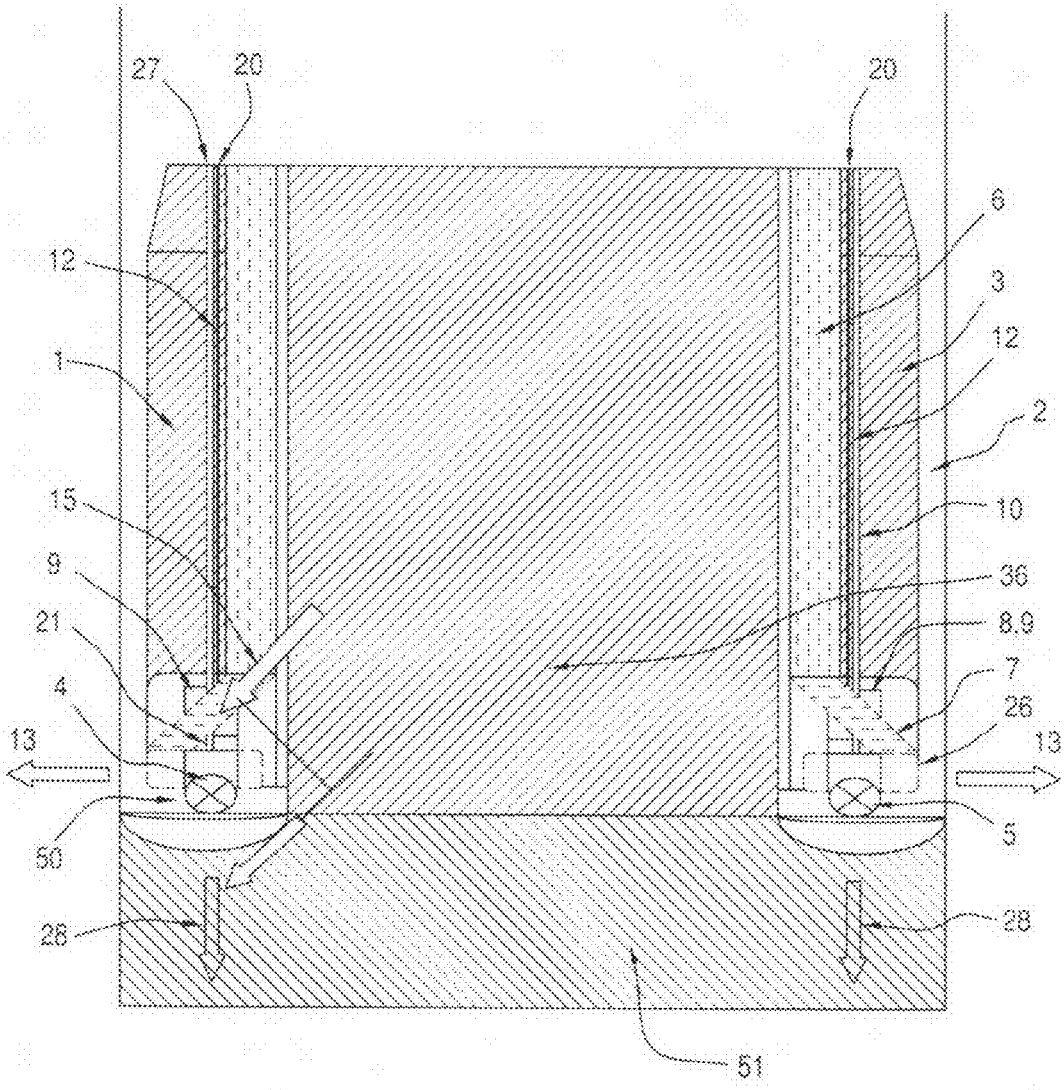
Figure 2F:
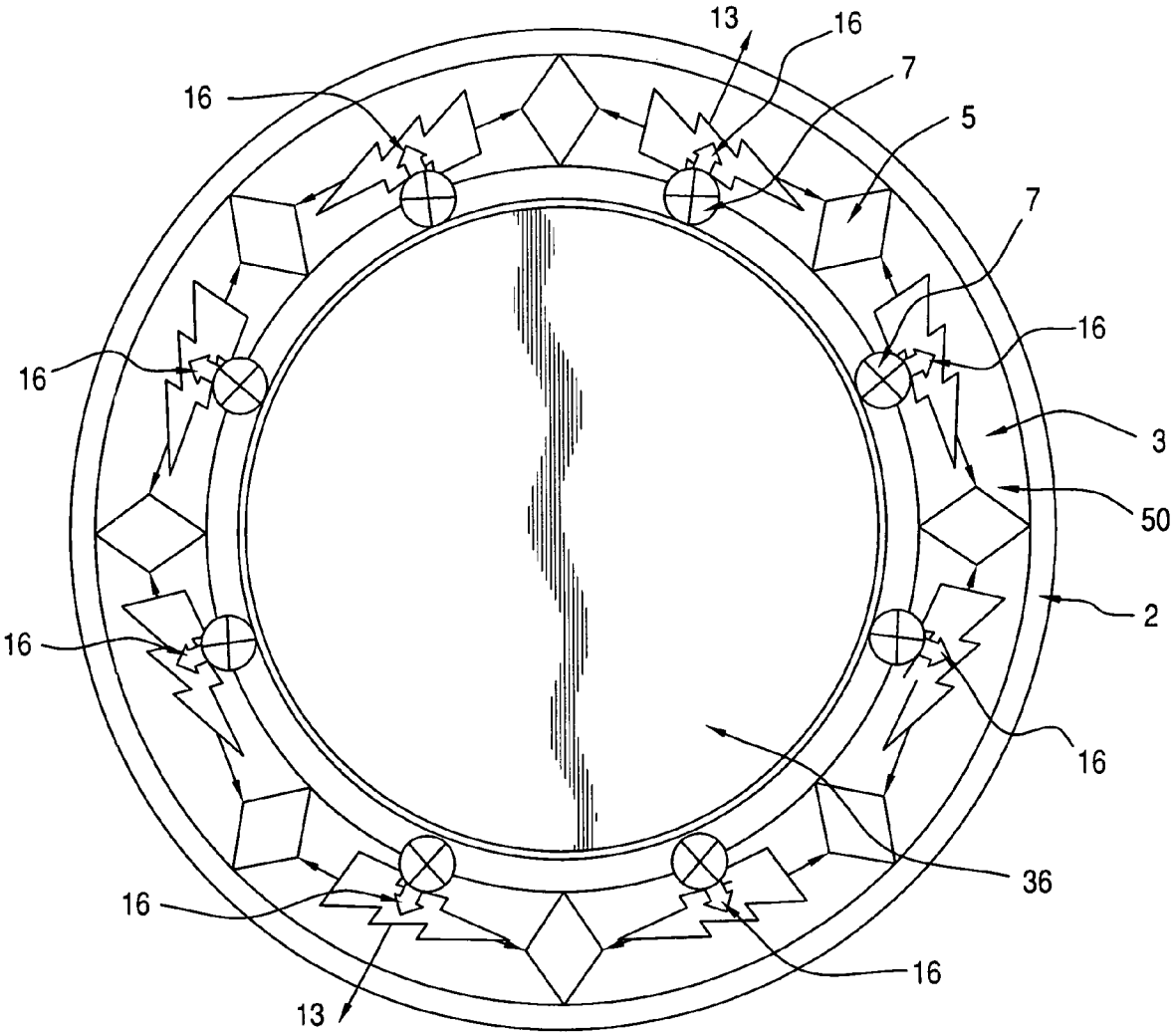
Figure 3A:
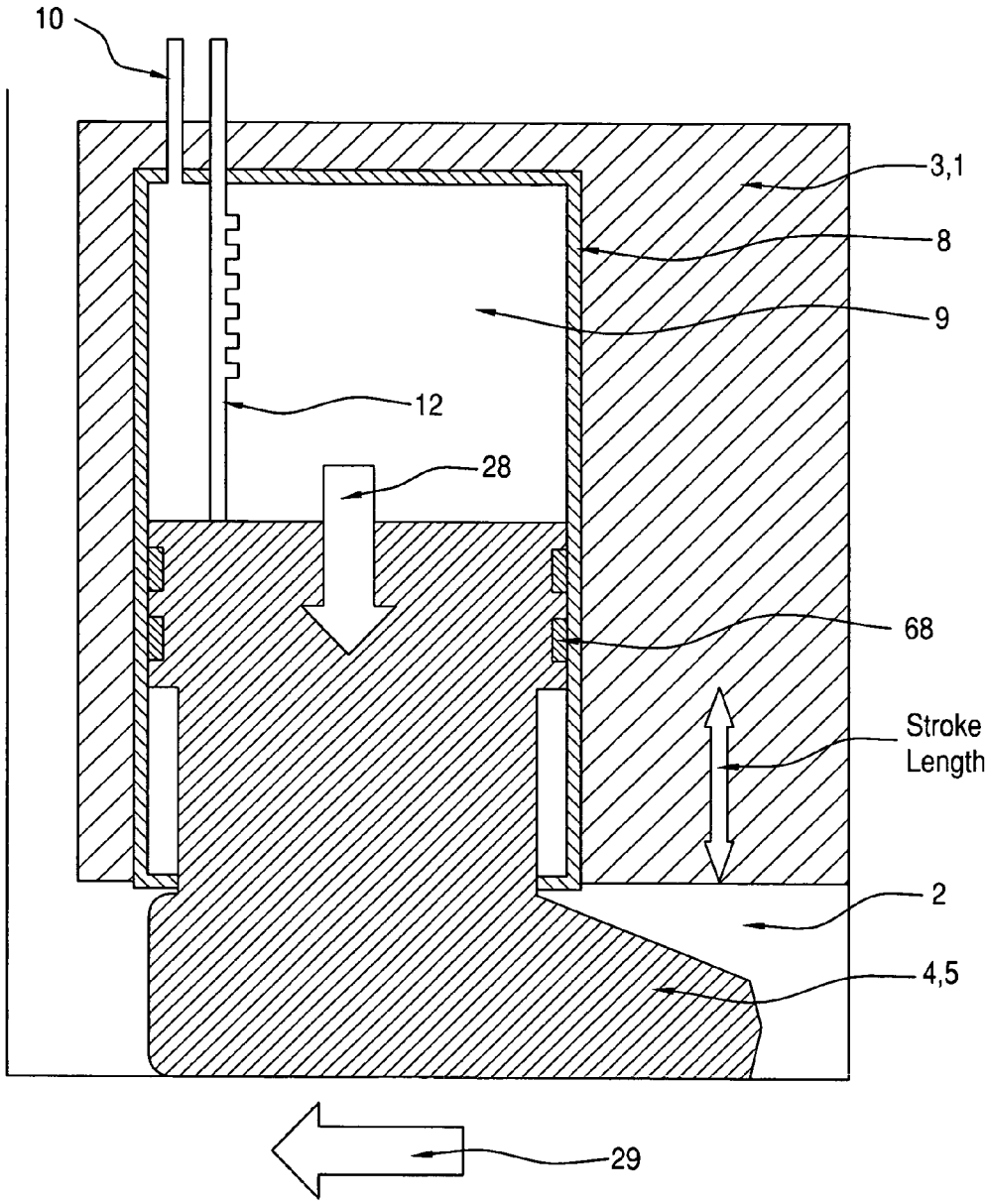
Figure 3B:
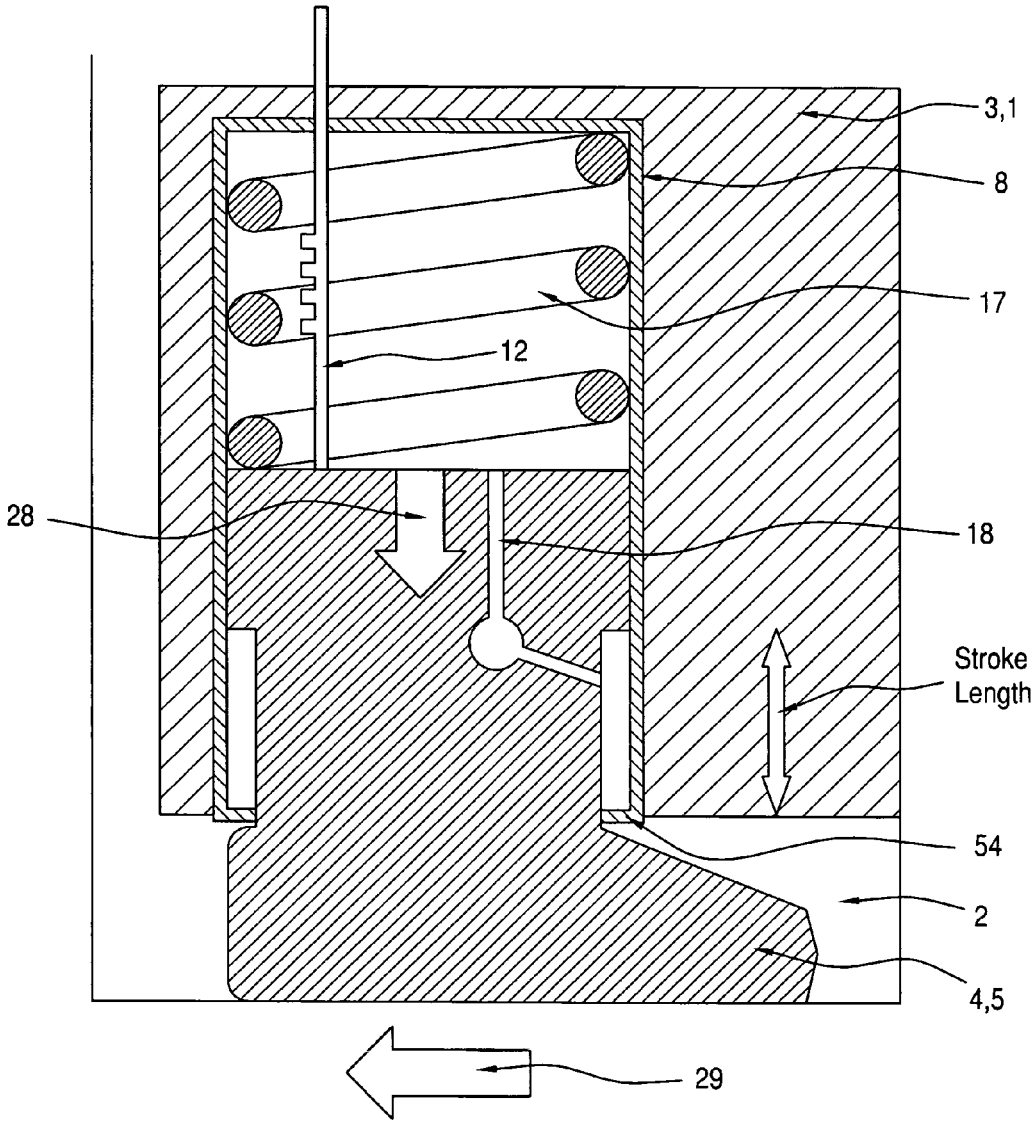
Figure 3C:
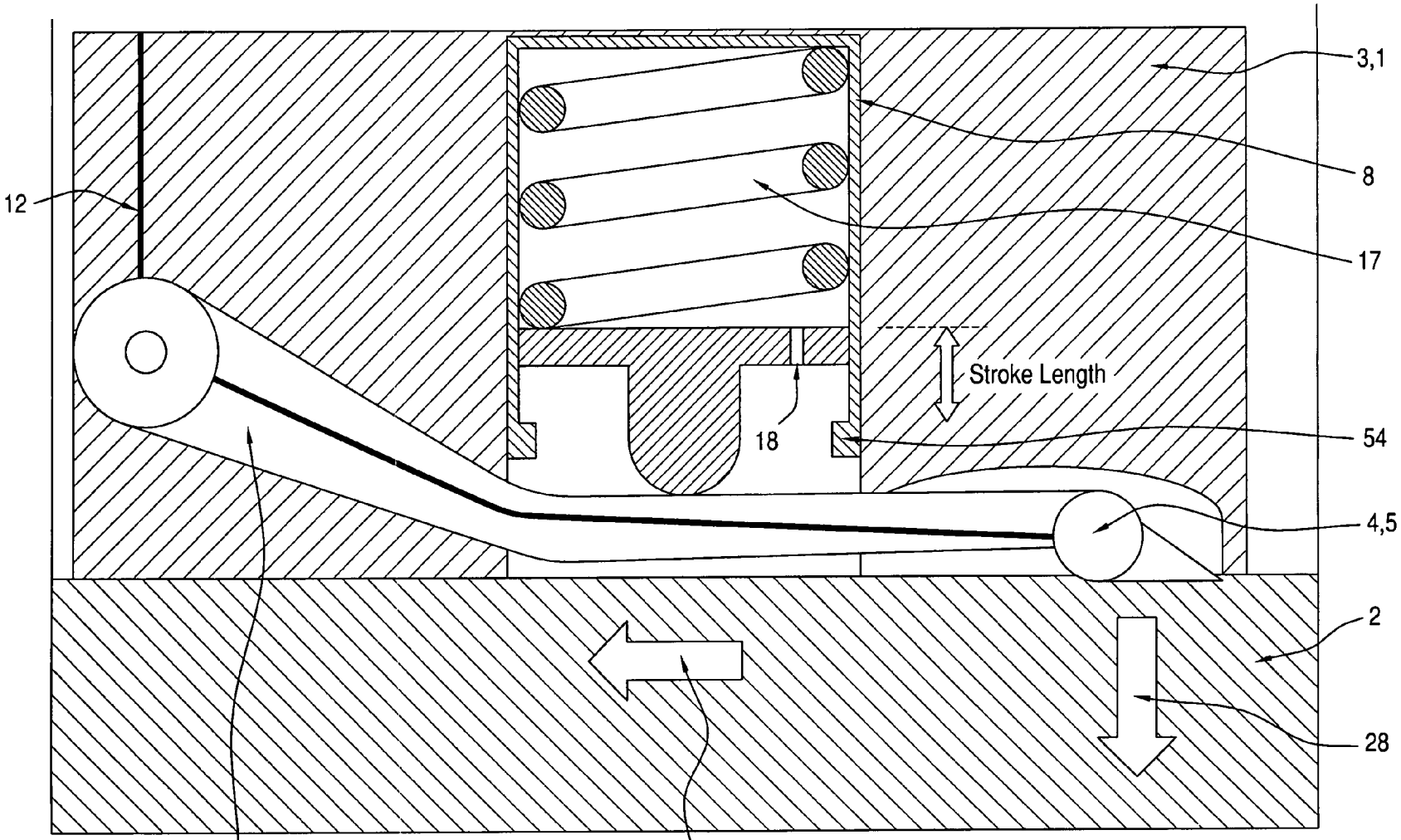
Figure 3D:
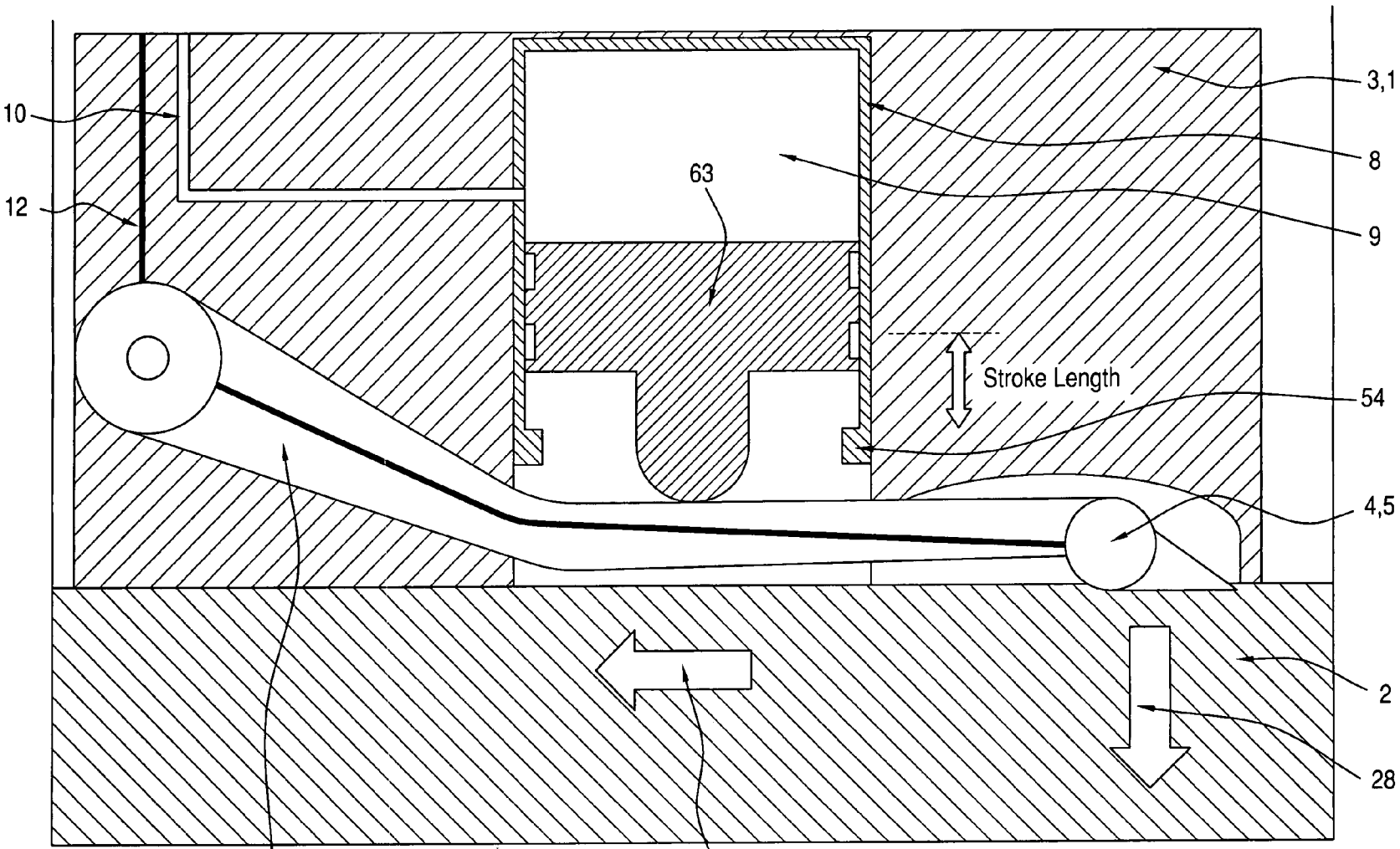
Figure 3E:
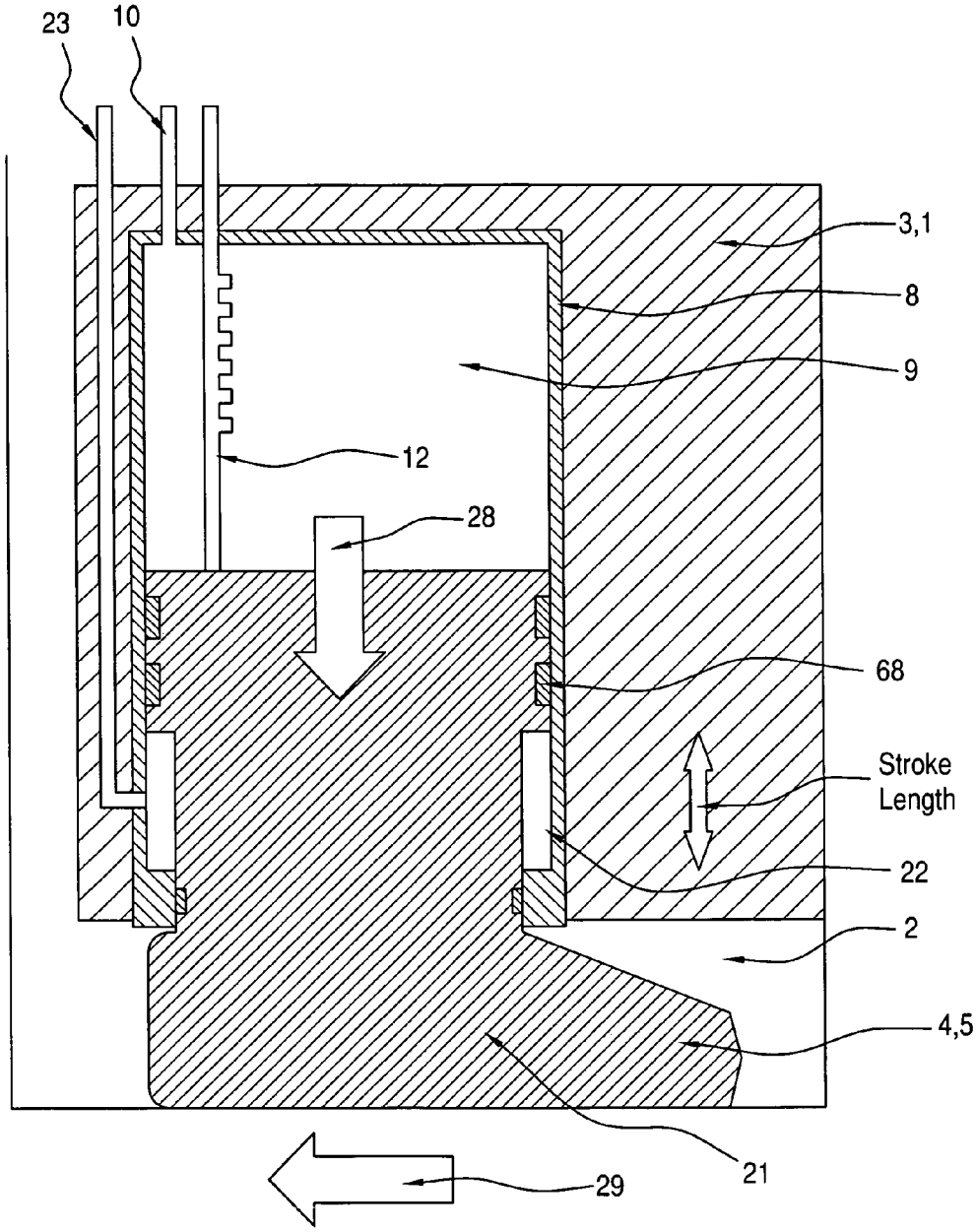
Figure 3F:
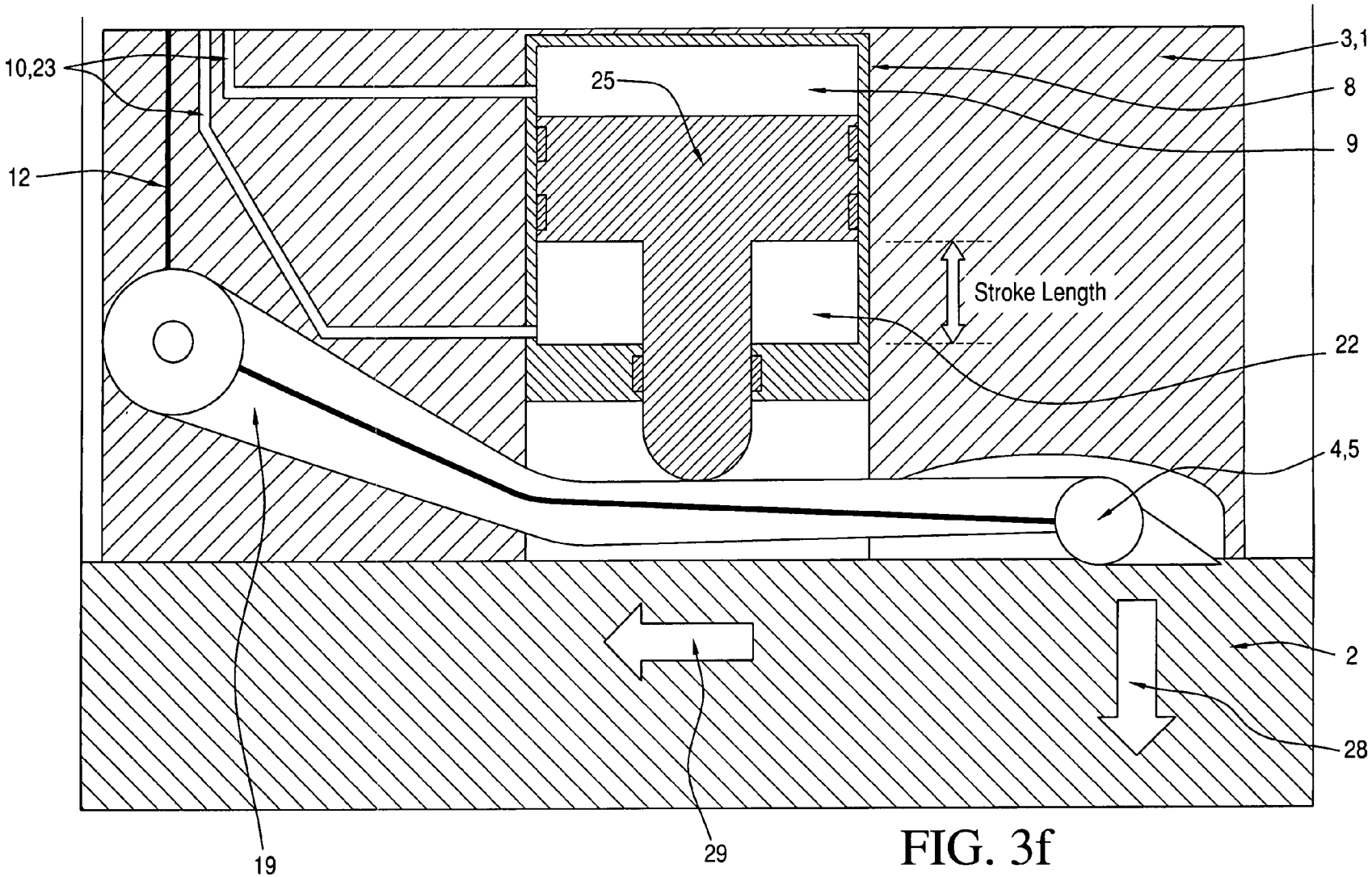
Figure 4A:
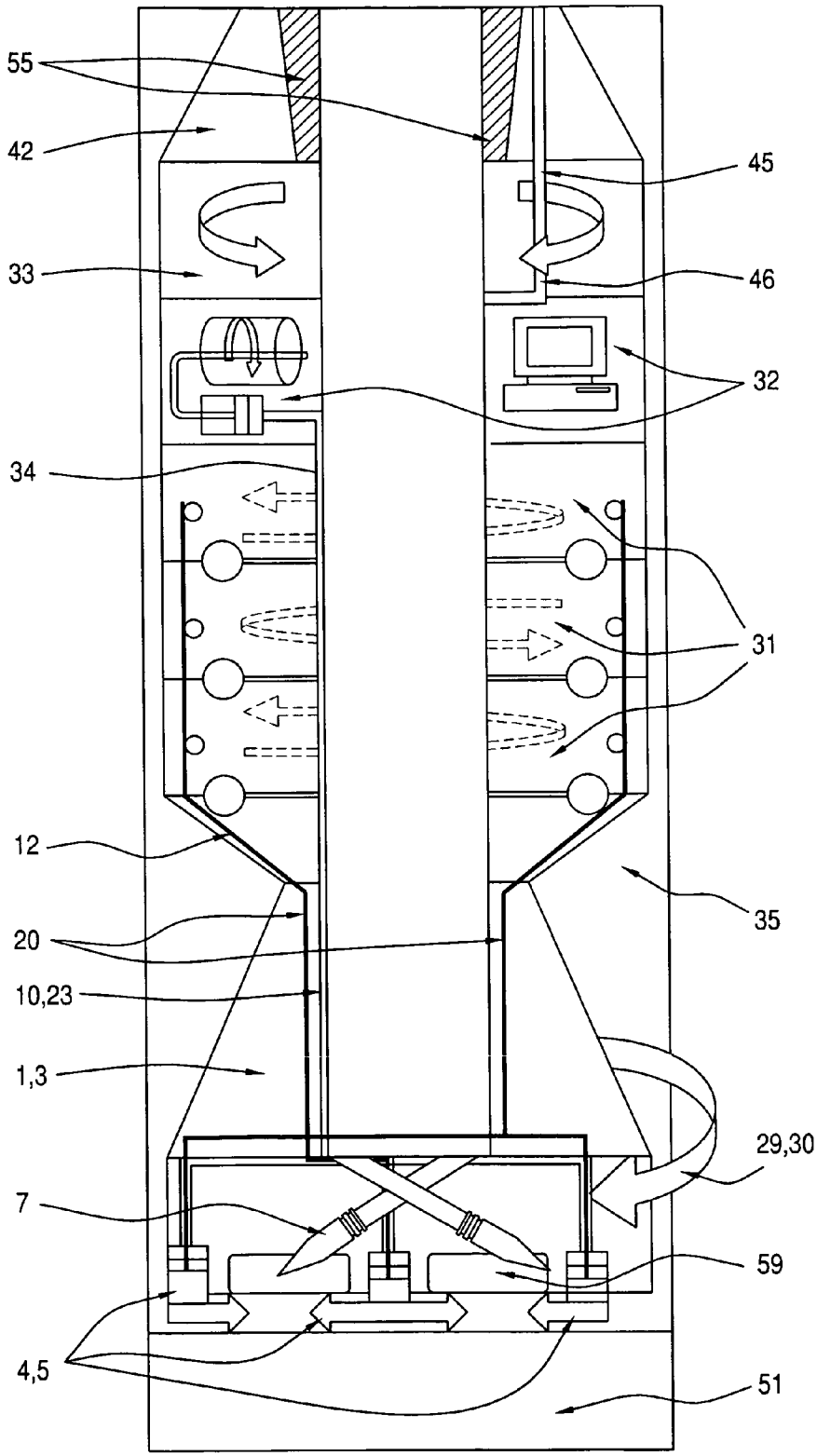
Figure 4B:
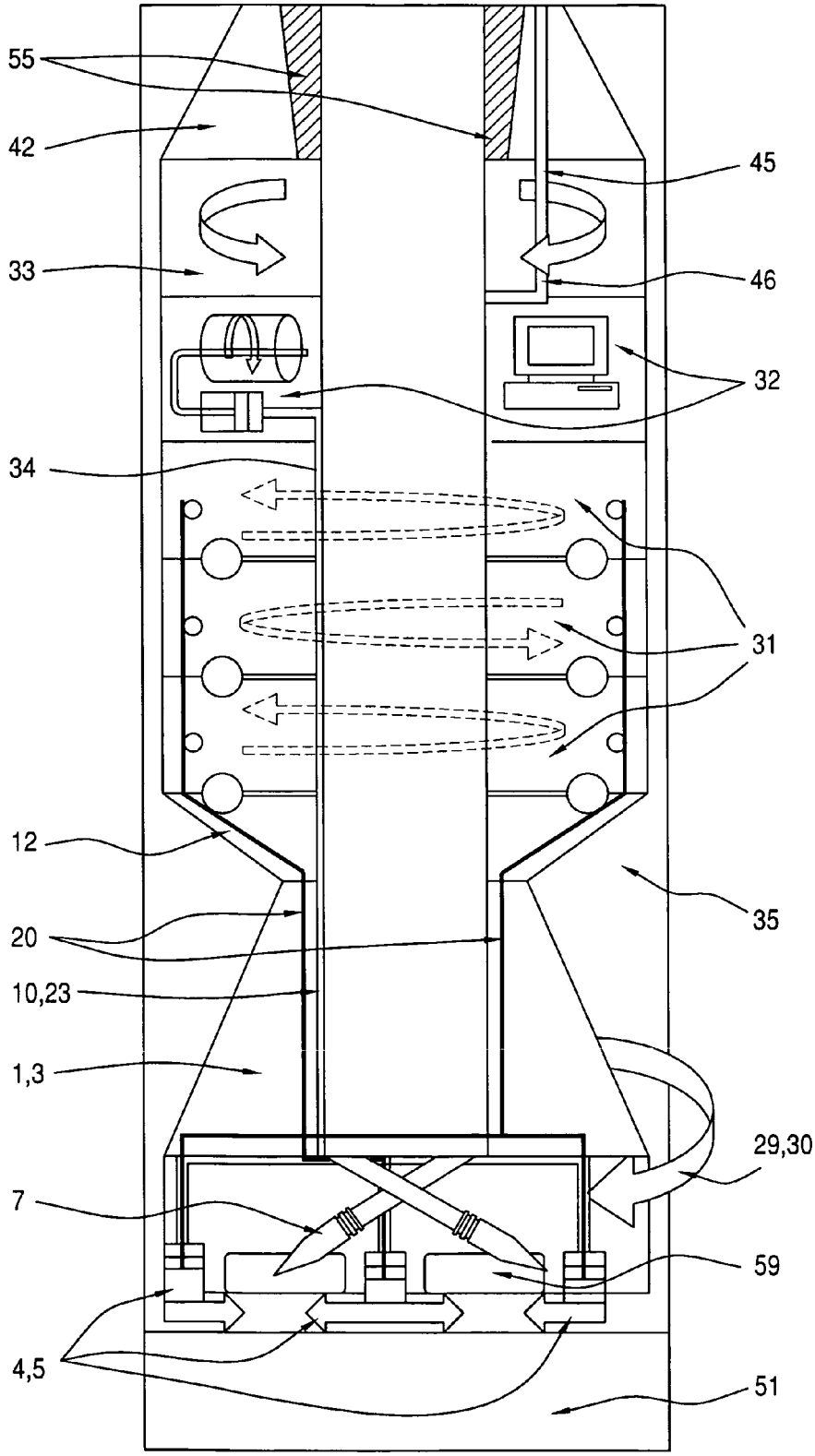
Figure 4C:
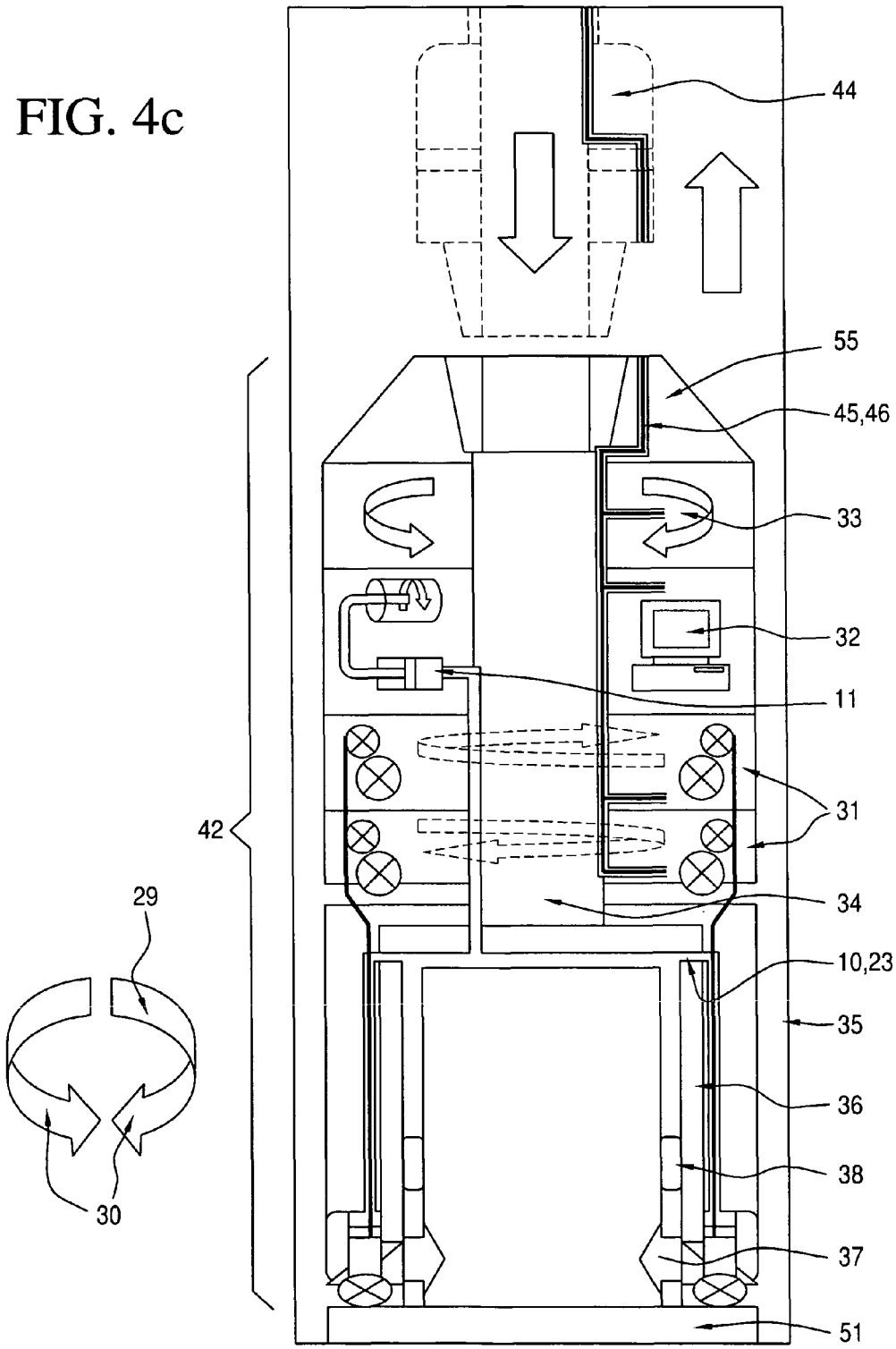
Figure 4D:
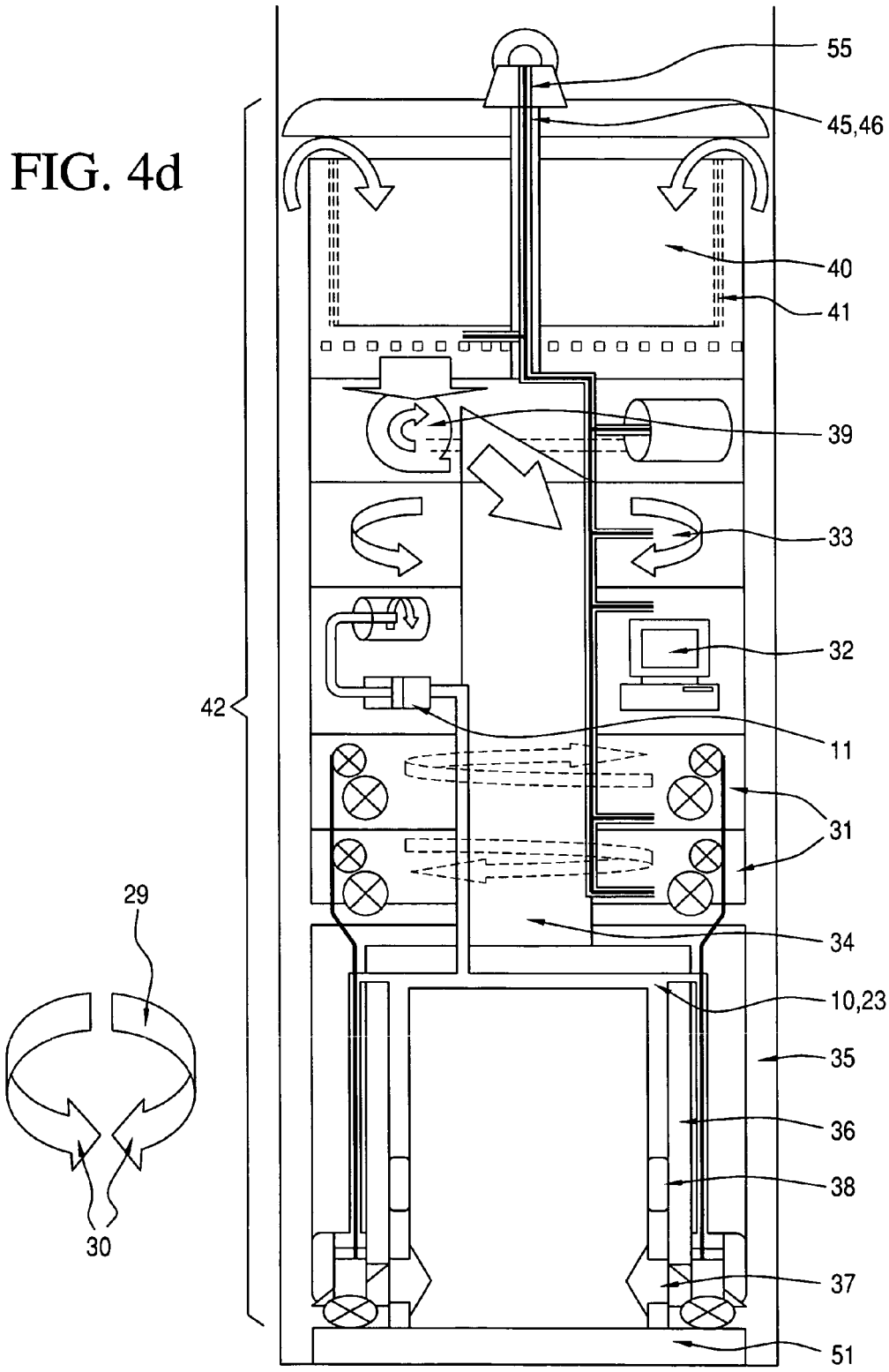
Figure 5A:
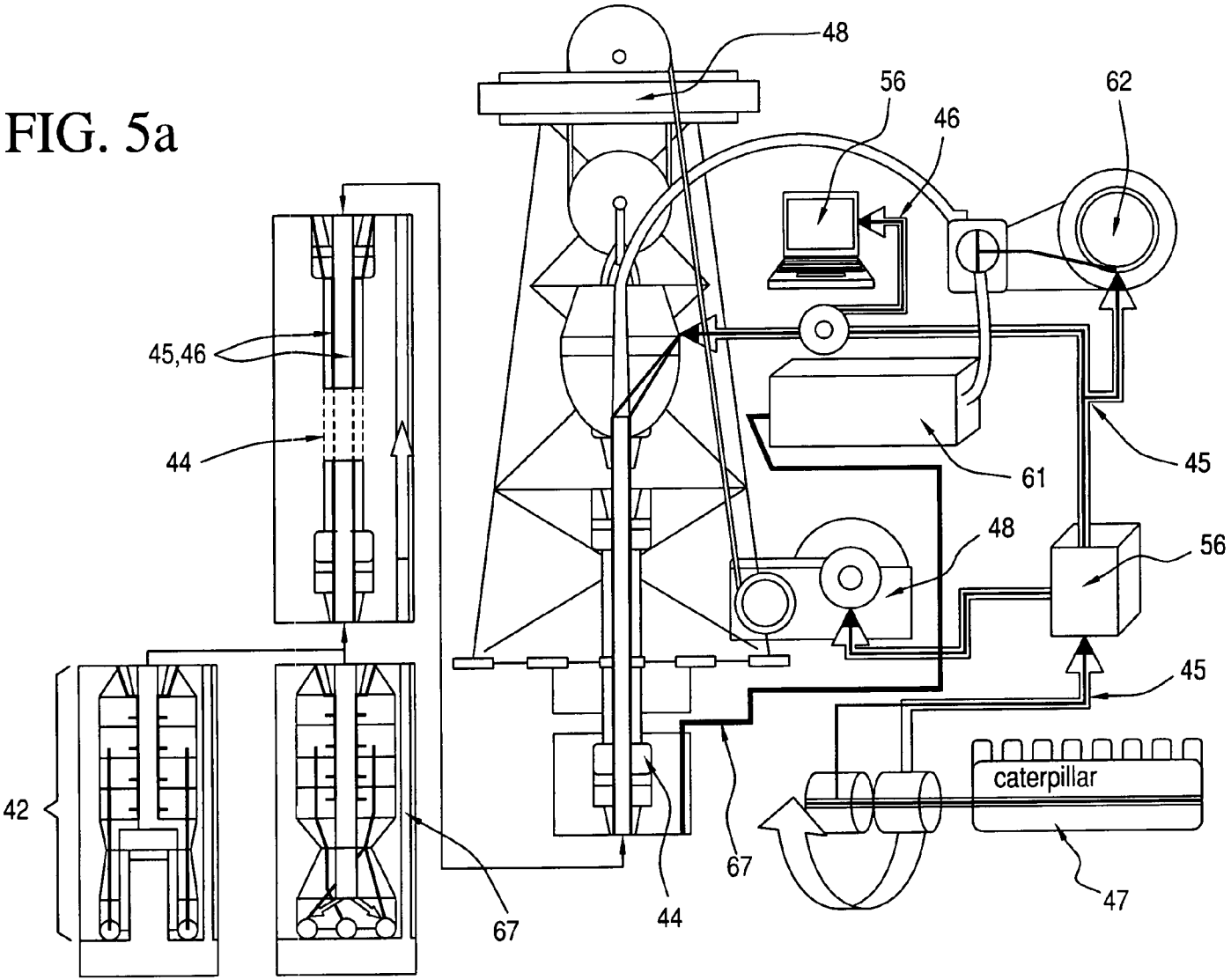
Figure 5B:
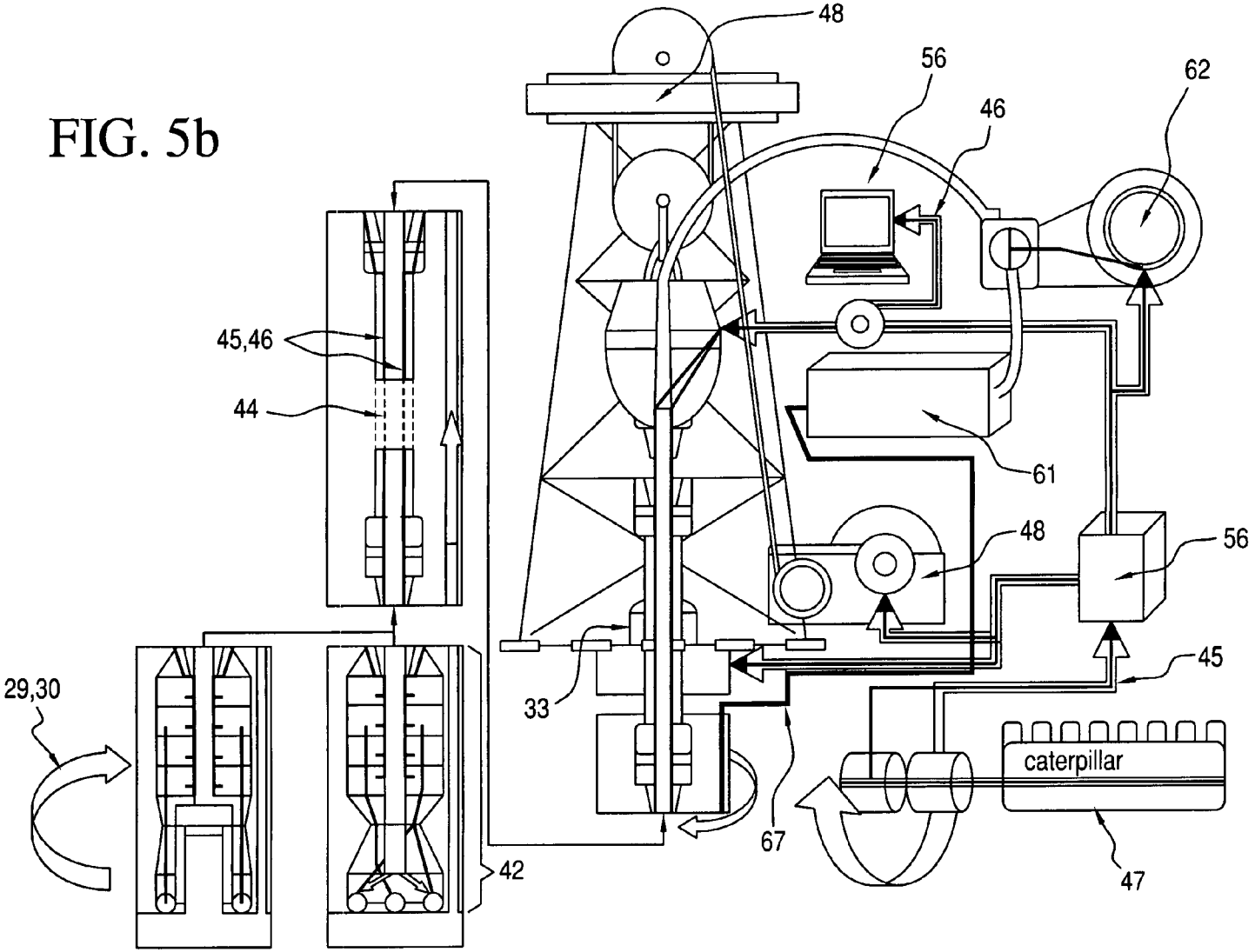
Figure 5C:
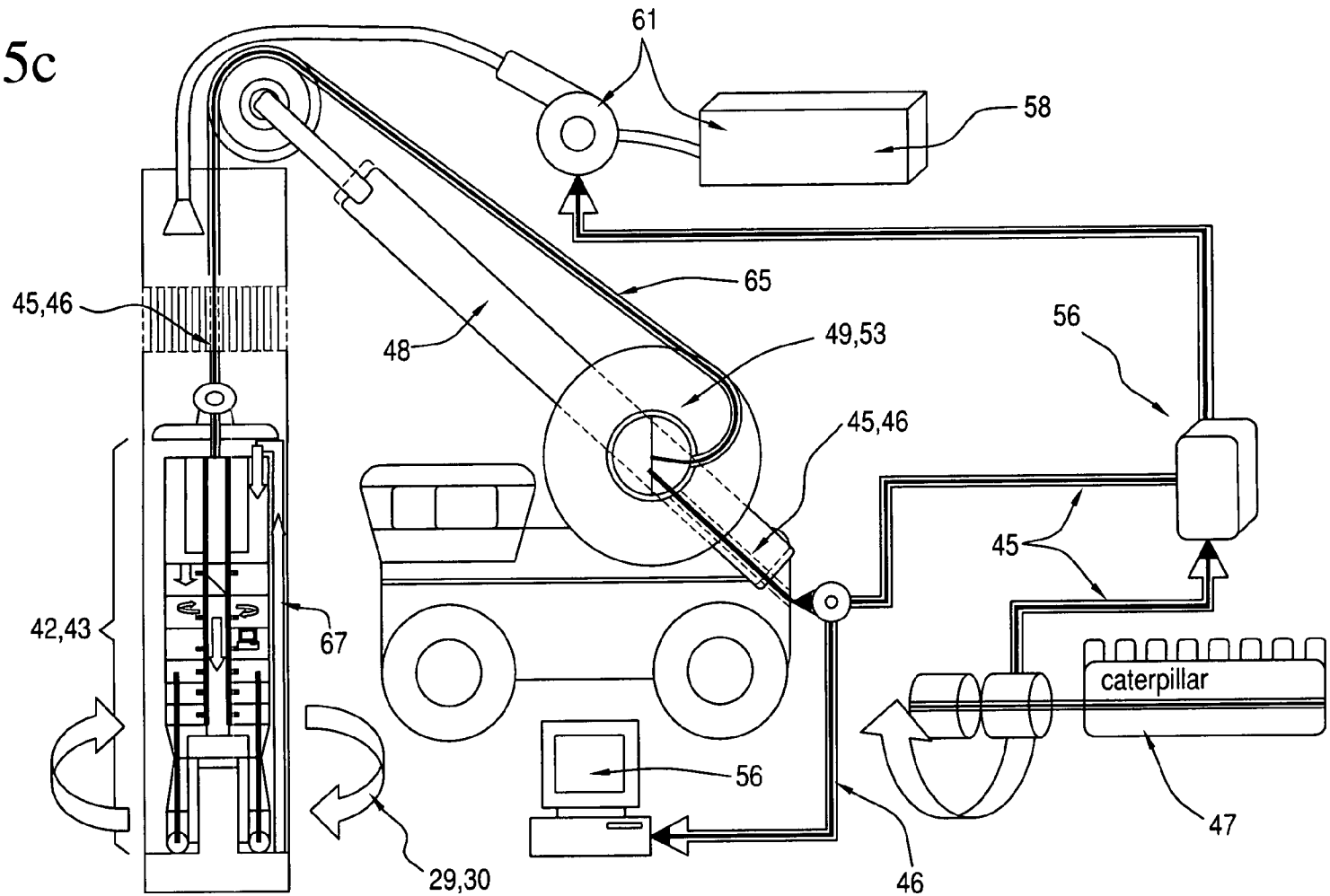

Embodiments of the invention are illustrated schematically in the drawings, in which FIG. 1*a* shows a schematic end view of a first embodiment (A) of a drill bit for a device according to the invention, FIG. 1*b* shows a schematic axial section of the drill bit of FIG. 1*a*, FIG. 2*a* shows a schematic end view of a second embodiment (B) of a drill bit for a device according to the invention, FIG. 2*b* shows a schematic axial section of the drill bit of FIG. 2*a*, FIG. 2*c* shows a schematic end view of third embodiment (C) of a drill-bit for a device according to the invention, FIG. 2*d* shows a schematic end view of an alternative embodiment of the drill bit in FIG. 2*c*, FIG. 2*e* shows a schematic longitudinal cross section of the drill bit in FIG. 2*c*, FIG. 2*f* shows an end view of a drill bit of the third embodiment (C) for non-rotational operation, FIG. 3*a* shows an axial section through a first embodiment of a drillbit, FIG. 3*b* shows an axial section through a second embodiment of a drillbit, FIG. 3*c-f* shows an axial section through further embodiments of a drillbit FIG. 4*a* shows an axial section through a first embodiment of a bottom hole assembly, FIG. 4*b* shows an axial section through a second embodiment of a bottom hole assembly, FIG. 4*c* shows an axial section through a third embodiment of a bottom hole assembly, FIG. 4*d* shows an axial section through a fourth embodiment of a bottom hole assembly, FIG. 5*a* shows an exploded side view of drilling rig with a non-rotational bottom hole assembly, FIG. 5*b* shows a view corresponding to FIG. 5*a*, of a drilling rig win rotational bottom hole assembly, FIG. 5*c* shows a side view of a mobile drilling rig with a bottom hole assembly according to FIG. 4*d*.

FIG. 1*a* shows an end view of a drill-bit 1 according to Embodiment A of the invention with multiple electrodes 4,5 for full borehole 2 cross-sectional electric discharge excavation from the rock matrix 51 without bit rotation, said bit 1 composed of boss 3 with electrode holders embodied as hydraulic cylinders 8 or mechanical devices 17,19 or other, including feeder lines 10,23 where applicable, embedded in it, one set of high voltage electrodes 4 and one set of ground electrodes 5 mounted in the holders with the necessary cabling 12 attached, bored channels 6 for the discharge fluid with nozzles 7 incorporated and terminal endings 27 at the top of the bit boss for hook-up to the hydraulic and electric supplies.

FIG. 1*b* shows a cut through the drill-bit 1 in FIG. 1*a* according to Embodiment A of the invention with multiple electrodes 4,5 for full borehole 2 cross-sectional electric discharge excavation from the rock matrix 61 without bit rotation, said bit 1 composed of boss 3 with electrode holders embodied as hydraulic cylinders 8 or hinged arms 17,19 or other, including feeder lines 10,23 where applicable embedded in it, one set of high voltage electrodes 4 and one set of ground electrodes 5 mounted in the holders with the necessary cabling 12 attached, bored channels 6 through the bit boss for the discharge fluid with nozzles 7 and open channels 26 with cross-sectional area 59 cut in the face of the bit boss along the preferred directions of cuttings' exit 13 out from the area 50 under the bit incorporated and terminal endings 27 at the top of the bit boss for hook-up to the hydraulic and electric supplies.

FIG. 2*a* shows an end view and FIG. 2*b* shows a cross-sectional view of a drill-bit 1 according to Embodiment B of the invention with rotational direction 29 or oscillatory movement 30 as indicated and a plurality of electrodes 4,5 positioned along the pattern of a letter S on the face of the bit boss 3 for full borehole 2 cross-sectional electric discharge coverage with bit rotation, said bit 1 composed of boss 3 with electrode holders in the embodiment of hydraulic cylinders 8, mechanical devices 17,19 or other including feeder lines 10,23 where applicable, embedded in it, one set of high voltage electrodes 4 and one set of ground electrodes 5 mounted in the holders with the necessary cabling 12 attached, bored channels 6 for the discharge fluid with nozzles 7 incorporated and terminal endings 27 at the top of the bit boss for hook-up to the hydraulic and electric supplies.

FIG. 2*c* shows an end view of a drill-bit 1 according to Embodiment C of the invention with rotational direction 29 as indicated and one pair of electrodes 4,5 positioned on the face of the bit boss 3 so as to excavate a ring shaped borehole 2 cross-sectional area and provide for said area complete electric discharge coverage when rotating at a suitable speed, said bit 1 composed of a bit boss 3 with electrode holders in the embodiment of hydraulic or mechanical cylinders 8,17, hinged arms 19 or other including feeder lines 10,23 where applicable embedded in it, one high voltage electrode 4 and one ground electrode 5 mounted in the holders with the necessary cabling 12 attached, bored channels 6 for the discharge fluid with nozzles 7 incorporated and terminal endings 27 at the top of the bit boss for hook-up to the hydraulic and electric supplies and mechanical scrapers, cutters or similar devices 66.

FIG. 2*d* shows an end view and FIG. 2*e* shows a cross-sectional view of a drill-bit 1 and core barrel 36 according to Embodiment C of the invention with rotational direction 29 or oscillatory movement 30 as indicated and two pairs of electrodes 4,5 positioned on the face of the bit boss 3 opposite each other so as to excavate a ring shaped borehole 2 cross-sectional area and provide for said area complete electric discharge coverage when rotating at a suitable speed, said bit 1 composed of a bit boss 3 with electrode holders in the embodiment of hydraulic or mechanical cylinders 8,17 hinged arms 19 or other including feeder lines 10,23 where applicable embedded in it, two high voltage electrodes 4 and two ground electrodes 5 mounted in the holders with the necessary cabling 12 attached, bored channels 6 for the discharge fluid with nozzles 7 incorporated and terminal endings 27 at the top of the bit boss for hook-up to the hydraulic and electric supplies and mechanical scrapers, cutters or similar devices 66.

FIG. 2*f* shows an end view of a non-rotational drill-bit 1 according to Embodiment C of the invention with a plurality of electrodes 4,5 positioned around the entire circumference of the face of the bit boss 3 so that any of the electrodes 4,5 have an electrode of opposite polarity as its nearest neighbours at a distance S away corresponding to the discharge gap for the given bit thereby excavating a ring shaped borehole 2 cross-sectional area and provide for said area complete electric discharge coverage without rotational movement, said bit 1 composed of a bit boss 3 with electrode holders in the embodiment of hydraulic or mechanical cylinders 8,17 hinged arms 19 or other including feeder lines 10,23 where applicable embedded in it, one set of high voltage electrodes 4 and one set of ground electrodes 5 mounted in the holders with the necessary cabling 12 attached, bored channels 6 for the discharge fluid with nozzles 7 and preferred directions of cuttings' transport 13 incorporated and terminal endings 27 at the top of the bit boss for hook-up to the hydraulic and electric supplies.

FIG. 3*a* shows a detail of one preferred embodiment of the drill-bit 1 showing the plunger-type version of the hydraulically operated electrode, is a cross-sectional view of one electrode 4, its cylinder 8 and its linear direction of movement 28 co-axial to the direction of drilling 29, the fluid pressure chamber 9 for forward movement of the electrode 4, the hydraulic fluid supply line 10 for the fluid in the pressure chamber and the hydraulic fluid pump 11 situated in the drilling assembly behind the bit, further the electric cable 12 connected to the electrode 4 and arrangement for its entry into the cylinder 8 and its end terminal 20 at the top of the bit boss 3. Seals are shown at 68.

FIG. 3*b* shows a detail of one preferred embodiment of the drill-bit 1, showing the helical spring-type version of the mechanically operated electrode 4, is a cross-sectional view of one electrode 4, its cylinder 8 and its linear direction of movement 28 co-axial to the direction of drilling 29, the helical spring 17 for forward movement of the electrode and its end stop 54, the channels 18 for pressure equalization on the front and back side of the electrodes 4,5 further the electric cable 12 connected to the electrode and its end terminal 20 at the top of the bit boss 3.

FIG. 3*c* shows a detail of one preferred embodiment of the drill-bit 1 in the embodiment of a hinged arm-type embodiment of the helical spring-type mechanically operated electrode, is a cross-sectional view of one electrode 4 as the shaped tip of the hinged arm 19, the helical spring 17 for the forward movement of the hinged arm 19 and electrode 4 as arranged with its arm lifter 58 and situated in its holder 8 inside the bit boss 3, further the electric cable 12 connected to the electrode and its end terminal 20 at the top of the bit boss 3.

FIG. 3*d* shows a detail of one preferred embodiment of the drill-bit 1 in the embodiment of a hinged arm-type version of the plunger-type hydraulically operated electrode, is a cross-sectional view of one electrode 4,5 as the shaped tip of the hinged arm 19, the plunger 55 in its cylinder 8 as connected to the hinged arm 19 and bit boss 3 respectively, the fluid pressure chamber 9 for forward movement of the electrode, the hydraulic fluid supply line 10 for the fluid in the pressure chamber and the hydraulic fluid pump 11 situated in the drilling assembly behind the bit, further the electric cable 12 connected to the electrode and arrangement for its entry into the cylinder 8 and its end terminal 20 at the top of the bit boss 3.

FIG. 3*e* shows a detail on the drill-bit 1 showing the double-acting piston-type embodiment for active control of the hydraulically operated electrode, is a cross-sectional view of one electrode 4 with an integrated piston section 21 and its cylinder 8, the fluid pressure chambers 9,22 for forward and backward movement of the electrode, the hydraulic fluid supply lines 10,23 for the fluid in the pressure chambers, the valve manifold 24 including electric wiring for the operation of the cylinder pressure and the hydraulic fluid pump 11 the two latter details situated in the drilling assembly behind the bit, further the electric cable 12 connected to the electrode and arrangement for its entry into the cylinder 8 and its end terminal 20 at the top of the bit boss 3. Seals are shown at 68.

FIG. 3*f*, shows a detail of the drill-bit 1 showing the double-acting piston-type embodiment for active control of the hinged-arm mounted electrode, is a cross-sectional view of one hinged arm 19 with electrode 4,5 said hinged arm 19 connected to the double-acting piston 25 located inside its cylinder 8 with fluid pressure chambers 9,22 for forward and backward movement of the piston, said cylinder 8 and the hydraulic fluid supply lines 10,23 for the transport of hydraulic fluid to the pressure chambers incorporated into the drill-bit boss 3, the valve manifold 24 including electric wiring for the operation of the cylinder pressure and the hydraulic fluid pump 11 the two latter details situated in the drilling assembly behind the bit, further the electric cable 12 connected to the electrode and arrangement for its entry into the cylinder 8 and its end terminal 20 at the top of the bit boss 3.

FIG. 4*a* is relevant for full-profile borehole non-rotational drilling, shows the bottom hole assembly 42 of the invention comprising the drill-bit 1 with bit boss 3, electrodes 4,5 and nozzles 7, further comprising one or a plurality of down-hole pulse generators 31, the hydraulic actuator system 32 for the electrode position control, the connecting terminal 55 to the drill-string 44, and further shows the channels for discharge fluid flow 34 through or past the actuator 32, through or past the pulse generator 31 or generators 31, through the drill-bit boss 3, out on the hole bottom area 50 through the nozzles 7 and along the open channels 26 on the bit face in the preferred cuttings' exit direction 13 back up-hole to the surface in the annulus 35 surrounding the bottom hole assembly.

FIG. 4*b* is relevant for full-profile borehole rotational or oscillatory drilling, shows the bottom hole assembly 42 of the invention comprising the drill-bit 1 with bit boss 3, electrodes 4,5 and nozzles 7, further comprising one or a plurality of down-hole pulse generators 31, the drilling process control system 57 including the hydraulic actuator system 32 for the electrode position control, the rotational or oscillatory motor 33, the connecting terminal 55 to the drill-string 44, and further shows the channels for discharge fluid flow 34 through or past the motor 33, through or past the actuator 32, through or past the pulse generator or generators 31, through the drill-bit boss 3, through the nozzles 7 and along the open channels 26 on the bit face in the preferred cuttings' exit direction 13 back up-hole to the surface in the annulus 35 surrounding the bottom hole assembly.

FIG. 4*c* is relevant for ring-shaped borehole non-rotational, rotational or oscillatory drilling, shows the bottom hole assembly 42 of the invention comprising the drill-bit 1 with bit boss 3, electrodes 4,5 and nozzles 7, further comprising the core barrel 36 with core cutter 37 near its bottom and core holder 38 incorporated, furthermore one or a plurality of down-hole pulse generators 31, the drilling process control system 57 including the electro-hydraulic actuator system 32 for the electrode position control and core management, the rotational or oscillatory motor 33 when applicable, the connecting terminal 55 to the drill-string 44, and further shows the channels for discharge fluid flow 34 through or past the motor 33, through or past the actuator 32, through or past the pulse generator or generators 31, through the drill-bit boss 3, through the nozzles 7 and along the open channels 26 on the bit face in the preferred cuttings' exit direction 13 back up-hole to the surface in the annulus 35 surrounding the bottom hole assembly 42 and drill-string 44.

FIG. 4*d* is relevant for the ring-shaped borehole drilling, non-rotational, rotational or oscillatory, with closed-loop down-hole circulation, shows the bottom hole assembly 42 of the invention comprising the drill-bit 1 with bit boss 3, electrodes 4,5 and nozzles 7, further comprising the core barrel 36 with core cutter 37 near its bottom and core holder 38 incorporated, furthermore one or a plurality of down-hole pulse generators 31, the electro-hydraulic actuator system 32 for the electrode position control and core management, the rotational or oscillatory motor 33, the discharge fluid circulating pump 39, the cuttings' basket 40 including a discharge fluid cleaning system 41 and the holding tank 58 for return flow to the pump, the connecting terminal 55 to the drill-string 52, and further shows the channels for discharge fluid flow 34 through or past the motor 33, through or past the actuator 32, through or past the pulse generator or generators 31, through the drill-bit boss 3, out on the hole bottom area 50, through the nozzles 7 and along the open channels 26 on the bit face in the preferred cuttings' exit direction 13 back up-hole through the annulus 35 surrounding the bottom hole assembly 42 to the entry section of the discharge fluid cleaning section 41, the cuttings' basket 40 and holding tank 58.

FIG. 5*a* is relevant for the full-profile borehole or ring-shaped borehole non-rotational drilling shows the entire drilling machine 43 comprising the bottom hole assembly 42 according to FIG. 5*a* or FIG. 5*c*, the drill-string 44 consisting of jointed pipe, reeled steel tubing known as coiled tubing or a suitable hose with a 2-conduit electric cable 45 incorporated in it and a 2-conduit electric signal cable 46 incorporated in it, furthermore at the surface the necessary means for power supply 47, hoisting 48, drill-string reeling when applicable 49, discharge fluid cleaning 61 and pumping 62 and all relevant auxiliary systems such as but not limited to a pressure control system 56.

FIG. 5*b* is relevant for the full-profile borehole or ring-shaped borehole rotational or oscillatory drilling shows the entire drilling machine 43 comprising the bottom hole assembly 42 according to FIG. 5*b* or FIG. 5*c*, the drill-string 44 consisting of reeled steel tubing known as coiled tubing or a suitable hose with a 2-conduit electric cable 45 incorporated in it and a 2-conduit electric signal cable 46 incorporated in it, furthermore at the surface the necessary means for power supply 47, hoisting 48, drill-string reeling 49, discharge fluid cleaning 61 and pumping 62 and all relevant auxiliary systems such as but not limited to a pressure control system 56.

FIG. 5*c* is relevant for the ring-shaped borehole drilling, non-rotational, rotational or oscillatory, with closed-loop down-hole circulation shows the entire drilling machine 43 comprising the bottom hole assembly 42 according to FIG. 5*d*, the drill-string 65 consisting of a steel wire rope with a 2-conduit electric cable 45 incorporated in it integrated with a 2-conduit electric signal cable 46, furthermore at the surface the necessary means for power supply 47, hoisting 48, wire-rope reeling 53 and the relevant auxiliary systems such as but not limited to a pressure control system 56.

The invention claimed is:

1. A drilling method for the drilling of boreholes in the ground, in which is circulated a suitable discharge fluid, comprising generating an electric discharge by high-voltage pulses between electrodes of opposite polarity, wherein the following elements have been incorporated:

i electrodes moveable relative to each other and a drill-bit boss in a manner so that bottom-hole physical contact be secured for all the electrodes on all relevant bottom-hole topographies, ii nozzle jetting of the circulating discharge fluid (with point of jetting impact on the hole-bottom and jetting vector direction specific relative to the actual discharge gaps) so as to lift and remove the primary cuttings instantly as they come loose and with pressure expansion across the nozzles at no less than 4 MPa, iii down-hole deployment of a minimum of one high-voltage pulse generator a minimum fixed distance from the drill-bit and supplied from the surface at a 1 KV or other practical voltage level, iv borehole cross-sectional excavation coverage by a combination of rotational or oscillatory movement of the drill-bit boss and a plurality of electrodes situated on the bit face along one or a few radii and tangents, v ring-shaped hole-making with core storage, core transportation, down-hole closed loop discharge fluid circulation with prime mover energy supply, discharge fluid cleaning and cuttings' storage incorporated in it.

2. A method as set forth in claim 1, wherein the electrodes are moveable along or in parallel, or as a minimum have a component of their ability to move along or in parallel to the direction of drilling, relative to each other and the drill-bit boss so that bottom-hole physical contact be secured for all the electrodes on all relevant bottom-hole topographies.

3. A method as set forth in claim 1, wherein one electrode is fixed relative to the drill-bit boss and all the other electrodes are movable relative to each other and the drill-bit boss.

4. A method as set forth in claim 1, wherein the movable electrodes are pushed forward relative to the drill-bit boss and allowed to find their individual positions as they hit the bottom profile of the hole-bottom.

5. A method as set forth in claim 1, wherein the movable electrodes are at any time manipulated so that one shifting electrode pair or one shifting group of electrode pairs are in contact with the bottom hole profile and the other are in their retracted position out of contact with the bottom hole profile.

6. A method as set forth in claim 1, wherein the high-voltage electric discharge pulses are generated by a down-hole pulse generator situated near, at a fixed distance from the drill-bit and following behind the drill-bit as the borehole deepens.

7. A method as set forth in claim 1, wherein the high-voltage electric discharge pulses are generated by a plurality of down-hole pulse generators situated near, at a fixed distances from the drill-bit, and following behind the drill-bit as the borehole deepens.

8. A method as set forth in claim 1, wherein all electrode gaps are electrically connected in parallel on equal terms to the pulse generator or generators.

9. A method as set forth in claim 1, wherein the electrode gaps are electrically connected in series on otherwise equal terms to the pulse generator receiving individually dedicated pulses staggered in time.

10. A method as set forth in claim 1, wherein the electrode gaps are electrically connected each to their dedicated pulse generator receiving pulses wholly, or partially independent of the other electrode gaps or according to a predetermined pulse distribution program.

11. A method as set forth in claim 1, wherein groups of electrode gaps are electrically connected each to their dedicated pulse generator and each electrode in a group receiving pulses in series within the group and wholly, or partially independent of the other groups or according to a predetermined pulse distribution program among the groups.

12. A method as set forth in claim 1, wherein each electrode pair or group of electrode pairs have their individual cable connection to their pulse generator.

13. A method as set forth in claim 1, wherein all electrode pairs or all groups of electrode pairs have wholly or partially common cable connection to their pulse generators and the individual pulse destination is given by a switching arrangement.

14. A method as set forth in claim 1, wherein directed high-pressure discharge fluid jetting is undertaken said direction being achieved by nozzles mounted on the face of the bit boss.

15. A method as set forth in claim 1, wherein the jetting pressure expanded across the nozzles is not less than 4 MPa.

16. A method as set forth in claim 1, wherein the jetting has points and direction of impact on the hole-bottom specific for each electrode gap so as to lift and remove the primary cuttings instantly as they come loose from their indigenous place in the rock matrix.

17. A method as set forth in claim 1, wherein is defined a priority direction for cuttings' removal out from under the bit.

18. A method as set forth in claim 1, wherein the priority direction for cuttings' removal out from under the bit is radial away from the hole centre.

19. A method as set forth in claim 1, wherein the priority direction for cuttings' removal out from under the bit is along a straight line or as near to a straight line as possible angled away from said radial direction as little as possible yet so that other electrodes on the bit face do not constitute a hindrance for any cuttings' exit out from under the bit or so that said hindrance is minimized.

20. A method as set forth in claim 1, wherein the priority direction for cuttings' removal out from under the bit is angled away from the radial direction opposite the direction of rotational movement.

21. A method as set forth in claim 1, wherein the vector direction of each jet is made to coincide or as nearly coincide as possible, with the direction of the crack formed as the primary cutting is broken loose as seen along the priority direction for cuttings removal out from under the bit.

22. A method as set forth in claim 1, wherein open channels or grooves are cut in the face of the drill-bit boss to allow passage for the cuttings along the priority directions of cuttings' removal out from under the bit.

23. A method as set forth in claim 1, wherein the high-voltage electric pulse generation is undertaken in the borehole at a fixed distance from the drill-bit as the drilling proceeds with its energy supply at a practical voltage level, from the surface or elsewhere.

24. A method as set forth in claim 1, wherein the high-voltage electric pulse generation is done by one pulse generator and all electrode gaps are hooked up in parallel on equal terms.

25. A method as set forth in claim 1, wherein the high-voltage electric pulse generation is done by one pulse generator and the electrode gaps are hooked up in series, each pulse having one dedicated electrode gap as its destination.

26. A method as set forth in claim 1, wherein the high-voltage electric pulse generation is done by one pulse generator and the electrode gaps are organized in groups which are served by the pulse generator in series, the electrode gaps in each group receiving the pulses in parallel on equal terms.

27. A method as set forth in claim 1, wherein the high-voltage electric pulse generation is done by two or more pulse generators and the electrode gaps are organized in one or a plurality of groups each group hooked up to one generator and the electrodes in each group being served in parallel or in series.

28. A method as set forth in claim 1, wherein the high-voltage electric pulse generation is done by a plurality of pulse generators and each electrode gap is served by its dedicated pulse generator.

29. A method as set forth in claim 1, wherein the drill-bit boss or a part of the drill-bit boss is given forced physical movement relative to the hole-bottom, and wherein at least one of the following modes of motion has been incorporated:

i one direction rotational movement of even speed;

ii one direction intermittent rotational movement;

iii one direction continual rotational movement with speed variation of any kind;

iv two direction continual oscillatory rotational movement of any frequency, amplitude or energy level;

v two direction intermittent oscillatory rotational movement of any frequency, amplitude, energy level or kind of intermittence;

vi two direction oscillatory linear movement in the axial direction of the borehole, of any frequency, amplitude, energy level, kind of intermittence or kind of interaction with the hole-bottom.

30. A method as set forth in claim 1, wherein physical interaction between the bit boss and the hole-bottom occurs as caused by the drill-bit movement in the form of cutting, scraping, hammering or any other kind of physical interaction.

31. A method as set forth in claim 1, wherein part of the face of the drill-bit boss has been given a layout wherein at least one of the following details has been incorporated:

i facial profiling of the drill-bit boss so as to create efficient interaction with the hole-bottom;

ii facial insertion of hard, sharp, abrasive, durable or in any other way suitable design elements so as to contribute to the lasting and efficient excavation and removal of loose cuttings from the hole-bottom.

32. A method as set forth in claim 1, wherein the borehole is created by a sequence of operations in which i the drilling of an annulus-shaped bore-hole segment of finite length allowing the solid core to rise inside a core barrel;

ii the circulation of discharge drilling fluid from a pump situated at the surface, down the hole through the drill-string, through nozzles incorporated in the ring-shaped drill-bit, up the annulus surrounding the bottom hole assembly and drill-string to the surface, into the discharge fluid tanks and its integrated fluid separation and cleaning system; thereafter back to the suction side of the pump for re-circulation;

iii the in-situ cutting in the core barrel of the core at or near its root;

iv the attachment of the core to the core barrel;

v the hoisting to the surface of the entire bottom hole drilling assembly including the core, the core barrel and the drill-string;

vi the removal of the core from the core barrel;

vii the lowering of the entire bottom hole drilling assembly back to the hole bottom for sequence repetition.

33. A method as set forth in claim 1, wherein the borehole is created by the a sequence of operations in which i the drilling of an annulus-shaped bore-hole segment of finite length allowing the solid core to rise inside a core barrel;

ii the circulation of discharge drilling fluid from a pump situated in the bottom hole assembly, through nozzles in the ring-shaped drill-bit, up the annulus surrounding the bottom hole assembly to the entry section of a cuttings' basket situated at the top of the bottom hole assembly, into the basket and its integrated fluid separation and cleaning system; thereafter back to the suction side of the pump for re-circulation;

iii the in-situ cutting in the core barrel of the core at or near its root;

iv the attachment of the core to the core barrel;

v the hoisting to the surface of the entire bottom hole drilling assembly including the core, the core barrel and the cuttings' basket;

vi the removal of the core from the core barrel and the cuttings from the basket;

vii the lowering of the entire bottom hole drilling assembly back to the hole bottom for sequence repetition.

34. A drilling machine for the drilling of boreholes in the ground, in which is circulated a suitable discharge fluid, by the utilization of electric discharge generated by high-voltage pulses between electrodes of opposite polarity, wherein the following elements have been incorporated in the overall machine i a drill-bit with movable electrodes relative to each other and the drill-bit boss in a manner so that bottom-hole physical contact be secured for all the electrodes on all relevant bottom-hole topographies;

ii pointed hydraulic nozzles for nozzle jetting of the circulating fluid (with point of jetting impact on the hole-bottom and jetting vector direction specific relative to the actual discharge gaps) so as to lift and remove the primary cuttings instantly as they come loose and with pressure expansion across the nozzles at no less than 4 MPa;

iii a minimum of one high-voltage pulse generator deployed down-hole at a minimum fixed distance from the drill-bit and supplied from the surface at a 1 KV or other practical voltage level;

iv a rotating or oscillating bit causing the borehole cross-sectional excavation coverage to occur by a combination of rotational or oscillatory movement of the drill-bit boss and electric discharge between a plurality of electrodes situated on the bit face along one or a few radii and tangents;

v a bottom hole assembly for ring-shaped hole-making with core storage, core transportation, down-hole closed loop discharge fluid circulation with prime mover energy supply, discharge fluid cleaning and cuttings' storage incorporated in it.

35. A drill-bit for a drilling machine according to claim 34, for the drilling of a borehole in the ground by the utilization of electric discharge generated by high-voltage pulses between a minimum of two electrodes (4,5) of opposite polarity said bit 1 composed of a bit boss-(3) wherein are incorporating channels (6) for a suitable discharge fluid to flow from a channel inlet (27) on the back side of the bit (1) to exchangeable nozzles (7) incorporated at the face of the bit (1) and open channels (26) at the surface of the boss (3) for cuttings' transportation from each gap between electrodes (4,5) of opposite polarity to the periphery of the bit 1, and fixtures (8, 17, 19) by which the electrodes (4,5) are connected to the boss (3), said electrodes being divided in one set of high voltage electrodes 4 and one set of ground electrodes (5) each electrically connected to a terminal (27) at the back side of the bit (1), wherein i the electrodes (4,5) are all moveable relative to each other and the drill-bit boss 3 so that bottom-hole contact may be obtained at all times for all the electrodes on all relevant bottom-hole topographies;

ii the electrodes (4,5) are all but one individually moveable relative to each other and the drill-bit boss 3 so that bottom-hole contact be obtained at all times for all the electrodes on all relevant bottom-hole topographies.

36. A drill-bit as set forth in claim 35, wherein the mode of electrode motion is according to one or a combination of the following alternatives i forward movement only of all the movable electrodes (4,5), along or at least with a component of their movement along axis' parallel to the direction of drilling as caused by a force or a combination of forces;

ii controlled forward and backward individual movement of each movable electrode (4,5) along or at least with a component of their movement along axis' parallel to the direction of drilling causing each electrode (4,5) to move according to an imposed impulse;

iii movement in any other way or combination of ways so that bottom-hole contact may be obtained at all times for all the electrodes on all relevant bottom-hole topographies.

37. A drill-bit for a drilling machine as set forth in claim 34, wherein the mode of electrode movement is along or at least with a component of their movement along axis' parallel to the direction of drilling and according to one or a combination of the following alternatives, wherein i all moveable electrodes (4,5) to move forward and find their individual positions as they hit each their point of contact on the bottom profile of the borehole;

ii advancing the movable electrodes individually forward or retracting them individually backward, the electrodes normally but not necessarily either being in their fully retracted position or forward in individual positions as given by their contact with the bottom profile of the borehole.

38. A drill-bit for a drilling machine as set forth in claim 34, wherein the means of electrode operation are according to one or a combination of the following alternatives i one-way actuation of each movable electrode forward in the borehole;

ii two-way actuation of each movable electrode forward and backwards in the borehole.

39. A drill-bit for a drilling machine as set forth in claim 34, wherein the means of electrode motion are one or a combination of the following alternatives i one-way hydraulic actuation forward in the borehole of each movable electrode (4,5) said electrode (4,5) configured as a plunger in a hydraulic cylinder fixture (8) with the cylinder fixed on the drill-bit boss (3) axially in parallel with the direction of drilling and in which the plunger will move forward when hydraulic pressure is applied behind it;

ii two-way hydraulic actuation of each movable electrode (4,5) said electrode configured as a piston in a hydraulic cylinder fixture 8 with the cylinder (8) fixed on the drill-bit boss 3 axially in parallel with the direction of drilling and in which the piston will move forward when hydraulic pressure is applied behind it and backward when pressure is applied in the opposite direction on a ring surface incorporated for that purpose.

40. A drill-bit for a drilling machine as set forth in claim 34, wherein the means of electrode motion comprise one-way mechanical actuation forward in the borehole of each movable electrode (4,5) said electrode configured as a body of cylindrical, annular, prismatic or other cross-section and situated inside a hollow fixture (8) with hydraulic pressure equalized on all its surfaces, said fixture having cross-section similar to said electrode and incorporating a helical or other compressed spring (17) internally between its bottom and said electrode, and said hollow fixture being fixed on the drill-bit boss (3) axially in parallel with the direction of drilling, said compressed spring (17) causing the electrode to be moved forward in the fixture until stopped by outside forces or an end stop (54) incorporated in the fixture near its opening.

41. A drill-bit 1 for a drilling machine as set forth in claim 34, wherein the means of electrode motion are one or a combination of the following alternatives i one-way hydraulic actuation forward in the borehole of each movable electrode 4,5 said electrode 4,5 configured as an integral part of an arm 19 hinged on the drill-bit boss 3 and connected to a plunger 55 in a hydraulic cylinder fixture 8 fixed on the drill-bit boss 3, said arm 19 rotating around its axis in such a way that the movement of the electrode 4,5 will have a component in the axial forward direction in parallel with the direction of drilling when the plunger 55 is caused to move forward in the cylinder as hydraulic pressure is applied behind it;

ii two-way hydraulic actuation of each movable electrode 4,5 said electrode 4,5 configured as an integral part of an arm 19 hinged on the drill-bit boss 3 and connected to a piston 21 in a hydraulic cylinder fixture 8 fixed on the drill-bit boss 3, said arm 19 rotating around its axis in such a way that the movement of the electrode 4,5 will have a component in the axial direction, forward or backward in parallel with the direction of drilling as the piston 21 is caused to move forward when hydraulic pressure is applied behind it and backward when pressure is applied in the opposite direction in the pressure chamber 22 incorporated for that purpose.

42. A drill-bit 1 for a drilling machine as set forth in claim 34, wherein the means of electrode motion comprises one-way mechanical actuation forward in the borehole of each movable electrode 4,5 said electrode 4,5 configured as an integral part of an arm 19 hinged on the drill-bit boss 3 and connected to a body 58 of cylindrical, annular, prismatic or other cross-section and situated inside a hollow fixture 8 with hydraulic pressure equalized on all its-surfaces, said fixture having cross-section similar to said body 58 and incorporating a helical or other compressed spring 17 internally between its bottom and said body 58, and said hollow fixture being fixed on the drill-bit boss 3, said arm 19 rotating around its axis in such a way that the movement of the electrode 4,5 will have a component in the axial forward direction in parallel with the direction of drilling as said compressed spring causes the body 58 to be moved forward in the fixture until stopped by outside forces or an end stop 54 incorporated in the fixture near its opening.

43. A drill-bit 1 for a drilling machine as set forth in claim 34, wherein the means of electrode motion comprises one-way mechanical actuation forward in the borehole of each movable electrode 4,5 said electrode 4,5 configured as an integral part of an arm 19, said arm itself being configured as a spring with characteristics such as but not limited to a blade spring and fixed on the drill-bit boss 3 in such a way that the movement of the electrode 4,5 as a minimum will have a component in the axial forward direction in parallel with the direction of drilling as said spring-arm moves to unload its spring-force until stopped through contact with the hole bottom topography or because the spring has totally unloaded itself.

44. A drill-bit for a drilling machine as set forth in claim 35, wherein the projection on a plane normal to the direction of drilling of the face of the bit has a contour selected from the group consisting of a circle, a polygon, and any other type of contour characterized by a single closed line.

45. A drill-bit for a drilling machine as set forth in claim 35, wherein the projection on a plane normal to the direction of drilling of the face of the bit has a contour selected from the group consisting of two closed lines, one inside the other so as to describe a ring-shaped cross-sectional area in the form of two circles, polygons or any other combination of closed line contours, one inside the other.

46. A drill-bit 1 for a drilling machine as set forth in claim 34, wherein the open channels 26 have a cross-sectional area 59 big enough to allow primary cuttings as caused by said drill-bit 1 to flow through them and direction 13 so as for all cuttings to have left the area 2 under the drill-bit 1 as early as possible after their initial separation from the rock matrix 61, said direction 13 constituting the priority direction of cuttings movement for each electrode gap on the drill-bit 1 and being defined by but not limited to one or a combination of the following criteria i straight-line radial cuttings movement away from the centre of the bit 1 in the direction of its periphery;

ii straight-line or as near as possible to a straight-line cuttings movement in a direction or a combination of directions angled as little as possible away from the outwardly radial and yet directed so as for the cuttings to avoid impact or impact as little as possible with any potential hindrance present at the face of the bit such as but not limited to electrodes 4,5 or nozzles 7, on their travel from the electrode gap where they originated to the periphery of the bit 1;

iii cuttings movement away from the rotational direction or the next active electrode gap or gaps as may be relevant for each specific bit.

47. A drill-bit 1 for a drilling machine according to claim 34 for the drilling of a borehole in the ground by the utilization of electric discharge generated by high-voltage pulses between a minimum of two electrodes 4,5 of opposite polarity said bit 1 composed of a boss 3, wherein is incorporated channels 6 for a suitable discharge fluid to flow from a channel inlet 27 on the back side of the bit 1 to exchangeable nozzles 7 incorporated at the face of the bit 1 and open channels 26 with cross-sectional area 59 cut on the surface of the boss 3 for cuttings transportation from each gap between electrodes 4,5 of opposite polarity to the periphery of the bit 1, said electrodes being divided in one set of high voltage electrodes 4 and one set of ground electrodes 5 each electrically connected to a terminal 27 at the back side of the bit 1 wherein the exchangeable nozzles 7 are mounted on the face of the drill-bit boss 3 so that the fluid jets 52 with position and vector direction 14, 15, 16 originating from them aim in such direction that a maximum probability is created for each primary cutting to be instantly lifted and removed from its inherent place as a part of the rock matrix 51 upon separation from said matrix and made to exit as fast as possible from the area 50 under the drill-bit.

48. A drill-bit 1 for a drilling machine as set forth in claim 47, wherein said maximum probability for the lift and removal of each primary cutting instantly upon separation from the matrix is secured by nozzle 7 placement and direction so as to cause direct impact by a minimum of one fluid-jet 52 in the crack created between the cutting and the rock matrix as the cutting is initially broken loose.

49. A drill-bit 1 for a drilling machine as set forth in claim 47, wherein the vector direction 15,16 of the fluid jet at the moment of impact is along the direction of a tangent at the point of impact to the surface contour of the primary cutting as seen in said vector direction or as close to said tangent as practically possible.

50. A drill-bit 1 for a drilling machine as set forth in claim 46, wherein the vector direction 15,16 of the fluid jet at the moment of impact is composed of two vector components one of which is parallel to the priority direction of cuttings' transport out from under the bit for the subject electrode gap, said parallel component preferably but not necessarily being the major of the two components.

51. A drill-bit 1 for a drilling machine as set forth in claim 45, wherein said nozzles 7 are constructed according to one of the following principles or a combination of them, wherein i each of said nozzles 7 having its fluid flow permanently pointed in one and the same direction relative to the bit boss 3;

ii each of said nozzles 7 having its fluid flow divided in two or more directions said directions each permanently pointed in one and the same direction relative to the bit boss 3;

iii said nozzles 7 being constructed so that the fluid jet originating from them may be directed in different directions at different times, such as but not limited to the lift and removal of different primary cuttings which come loose at different time or the extended jetting of a primary cutting along its priority direction of cuttings' removal path.

52. A drill-bit 1 for a drilling machine as set forth in claim 45, wherein the fluid flow through the nozzles 7 is given sufficient hydraulic power to lift the primary cuttings instantly upon hydraulic impact from their cavities or lift them in a minimum of time, said hydraulic power P to be as given by the mathematical expression PKW=530 o D2,3 for all the nozzles 7 combined and where D (m) represents the borehole diameter, and cause a minimum of 3.5 MPa of pressure drop across each nozzle 7.

53. A bottom hole assembly 42 according to claim 34 for the drilling of boreholes in the ground, in which is circulated a suitable discharge fluid, by the utilization of electric discharge generated by high-voltage pulses between electrodes 4,5 of opposite polarity, wherein is incorporated the drill-bit 1 and a high-voltage pulse generator or a plurality of such generators 31 wherein the pulse generator 31 or pulse generators 31 each, is mounted in a fixed axial distance from the drill-bit 1 and behind as seen in the direction of drilling, and connected to it in the ways necessary, such as but not limited to electrically, hydraulically and mechanically, and wherein said distance is as short as possible and remains constant regardless of the bore-hole depth.

54. A bottom hole assembly 42 according to claim 34 for the drilling of boreholes in the ground, in which is circulated a suitable discharge fluid, by the utilization of electric discharge generated by high-voltage pulses between electrodes 4,5 of opposite polarity, wherein is incorporated the drill-bit 1 and a high-voltage pulse generator or a plurality of such generators 31 situated relative to the drill-bit in a position characterized by that the bit and the generator or generators remain in a fixed or near fixed position relative to each other with only a short distance between them as the drilling makes progress, further comprising a plurality of sub-systems such as but not limited to a combination of all or some of the following items i rotational power 33 for the purpose of creating rotational movement of the drill-bit 1, in the form of one direction fixed or variable speed rotation, oscillatory of any kind, intermittent rotational or oscillatory or any kind of rotational or other movement and made available by a suitable motor, hydraulic, electric or otherwise driven situated relative to the drill-bit in a position characterized by that the bit and the motor remain in a fixed or near fixed position relative to each other with only a short distance between them as the drilling makes progress;

ii a core barrel 36 of fixed length incorporating a core cutter 37 near its bottom and a core gripper 38 said core barrel unit situated relative to the drill-bit in a position characterized by that the bit and the core barrel remain in a fixed or near fixed position adjacent to each other as the drilling makes progress;

iii a cuttings separation 41 and temporary storage system 40 herein called cuttings' basket wherein the cuttings are segregated away from the discharge fluid and temporarily stored while cleaned discharge fluid is guided to a suction tank for re-circulation in the bottom section of the borehole said system situated relative to the in a position characterized by that the bit and cuttings' separation and temporary storage system remain in a fixed or near fixed position relative to each other as the drilling makes progress;

iv a discharge fluid circulating pump 39 whereby the discharge fluid is circulated in a closed bottom hole loop characterized by a flow-path generally axial to the borehole towards the hole-bottom, from the pressure side of the bottom hole circulating pump 39, through or past the components of the bottom hole assembly such as but not limited to and not necessarily in such order, through or past the motor 33, through or past the drilling process control and actuator system 32, through or past the pulse generator 31 or pulse generators 31, through or past the drill-bit 1 boss, out onto the hole bottom through the nozzles 7 and along the open channels on the drill-bit face in the priority cuttings' exit direction 13, returning by a switch of direction said direction being generally axial to the borehole away from the hole-bottom through channels made for this purpose in the said components of the bottom-hole assembly 42 or past the said components in the annulus surrounded by the bore-hole and said bottom-hole assembly 42 carrying with it the cuttings in suspension to the top of the cutting's basket 40 again making a switch of direction in favour of the original flow path direction said previously presented direction being generally axial to the borehole towards the hole-bottom, through the fluid cleaning section 41 of the cuttings' basket 40 wherein the cuttings are separated from the fluid and segregated for temporary storage in the basket 40, finally through a cleaned discharge fluid suction tank 58 from where the discharge fluid returns to the suction side of the pump 39, said pump situated relative to the drill-bit in a position characterized by that the bit and the pump remain in a fixed or near fixed position relative to each other as the drilling makes progress;

v a drilling process control unit 57 wherein is incorporated details such as but not limited to borehole information sampling and processing systems and a control and actuator system 32, computer based electro-hydraulic or other for the drilling operations such as but not limited to the electrode 4,5 management and positioning, the nozzles' 7 control for hydraulic impact direction and management by the coordination of electric discharge, the discharge fluid energy and volume flow in combination with or exclusive of bit movement and core barrel 36 management said control unit situated relative to the drill-bit in a position characterized by that the bit and the control unit remain in a fixed or near fixed position relative to each other with only a short distance between them as the drilling makes progress;

vi a connecting terminal 55 for a pipe conduit 44 to the surface, said terminal further characterized by that it facilitates the transfer of the discharge fluid and incorporates the electric power and signal transmission 45,46 to the bottom hole assembly;

vii a connecting terminal 55 to a line conduit such as but not limited to a steel wire-rope 65 with integrated electric power and signal cables 45,46 said terminal characterized by that it incorporates facilities for the electric power and signal transmission 45,46 from the surface to the bottom hole assembly.

55. A bottom hole assembly 42 according to claim 34 for the drilling of boreholes in the ground, in which is circulated a suitable discharge fluid, by the utilization of electric discharge generated by high-voltage pulses between electrodes 4,5 of opposite polarity, wherein is incorporated the drill-bit 1 and a high-voltage pulse generator or a plurality of such generators 31 situated relative to the drill-bit in a position characterized by that the bit and the generator or generators remain in a fixed or near fixed position relative to each other with only the core barrel 36 between them as the drilling makes progress, further comprising a plurality of sub-systems such as but not limited to i a core barrel 36 of fixed length incorporating a core cutter 37 near its bottom and a core gripper 38 said core barrel unit situated relative to the drill-bit in a position characterized by that the bit and the core barrel remain in a fixed or near fixed position adjacent to each other as the drilling makes progress;

ii rotational power 33 for the purpose of creating rotational movement of the drill-bit 1, in the form of one direction fixed or variable speed rotation, oscillatory of any kind, intermittent rotational or oscillatory or any kind of rotational or other movement and made available by a suitable motor, hydraulic, electric or otherwise driven situated relative to the drill-bit in a position characterized by that the motor remain in a fixed or near fixed position adjacent to the pulse generator or generators 31 as the drilling makes progress;

iii a drilling process control unit 57 wherein is incorporated details such as but not limited to borehole information sampling and processing systems and a control and actuator system 32, computer based electro-hydraulic or other for the drilling operations such as but not limited to the electrode 4,5 management and positioning, the nozzles' 7 control for hydraulic impact direction and management by the coordination of electric discharge, the discharge fluid energy and volume flow in combination with or exclusive of bit movement and core barrel 36 management said control unit situated relative to the drill-bit in a position characterized by that the control unit remain in a fixed or near fixed position said position being adjacent to or in the immediate proximity of and above the motor 33 as seen from the drill-bit as the drilling makes progress;

iv a discharge fluid circulating pump 39 whereby the discharge fluid is circulated in a closed bottom hole loop characterized by a flow-path generally axial to the borehole towards the hole-bottom, from the pressure side of the bottom hole circulating pump 39, through or past the components of the bottom hole assembly such as but not limited to and not necessarily in such order, through or past the drilling process control and actuator system 32, through or past the motor 33, through or past the pulse generator 31 or pulse generators 31, through or past the core barrel 36, through or past the drill-bit 1 boss, out onto the hole bottom through the nozzles 7 and along the open channels on the drill-bit face in the priority cuttings' exit direction 13, returning by a switch of direction said previously presented direction being generally axial to the borehole away from the hole-bottom through channels made for this purpose in the said components of the bottom-hole assembly 42 or past the said components in the annulus surrounded by the bore-hole and said bottom-hole assembly 42 carrying with it the cuttings in suspension to the top of the cutting's basket 40 again making a switch of direction in favour of the original flow path direction said previously presented direction being generally axial to the borehole towards the hole-bottom, through the fluid cleaning section 41 of the cuttings' basket 40 wherein the cuttings are separated from the fluid and segregated for temporary storage in the basket 40, finally through a cleaned discharge fluid suction tank 58 from where the discharge fluid returns to the suction side of the pump 39, said pump situated relative to the drill-bit in a position characterized by that the pump remain in a fixed or near fixed position said position being adjacent to or in the immediate proximity of and above the drilling process control unit 57 as seen from the drill-bit as the drilling makes progress;

v a cuttings' separation 41 and temporary storage system 40 herein called cuttings' basket wherein the cuttings are segregated away from the discharge fluid and temporarily stored while cleaned discharge fluid is guided to a suction tank for re-circulation in the bottom section of the borehole said system situated relative to the drill-bit in a position characterized by that the cuttings' separation and temporary storage system remain in a fixed or near fixed position said position being adjacent to or in the immediate proximity of and above the discharge fluid circulating pump 39 as seen from the drill-bit as the drilling makes progress;

vi a connecting terminal 55 to a line conduit such as but not limited to a steel wire-rope 65 with integrated electric power and signal cables 45,46 said terminal characterized by that it incorporates facilities for the electric power and signal transmission 45,46 from the surface to the bottom hole assembly and further characterized by that the terminal remain in a position said position being adjacent to or in the immediate proximity of and above the cuttings' separation and temporary storage system 41 as seen from the drill-bit thereby constituting the termination of the bottom hole assembly as seen from the drill-bit side.

56. A bottom-hole assembly 42 as set forth in claim 54 wherein the pulse generator or generators 31 have been made so as to allow the flow of discharge fluid to flow past according to one or a combination of the following alternatives i an internal conduit allowing the fluid to flow into the borehole through the generator body or sequence of bodies and out of the borehole through the annulus created by the borehole and the outer periphery of the generator body or sequence of bodies;

ii an external conduit, circular, annular or of any other cross-sectional form, allowing the fluid to flow into the borehole around the generator body or bodies and out of the borehole through the annulus created by the wall of the borehole and the outer periphery of the generator body including said external fluid conduit or sequence of bodies.

57. A drilling machine 43 according to claim 34 for the drilling of boreholes in the ground, in which is circulated a suitable discharge fluid from the surface, by the utilization of electric discharge generated by high-voltage pulses between electrodes of opposite polarity, said machine characterized by a bottom hole assembly 42, and comprising a plurality of sub-systems such as but not limited to a combination of all or some of the following items i a pipe conduit 44 connecting the upper extension 55 of the bottom hole assembly to the surface said conduit, wherein said conduit facilitates the transfer of the discharge fluid and incorporates the electric power and signal transmission 45,46 to the bottom hole assembly;

ii a steel wire rope 65 connecting the upper extension 55 of the bottom hole assembly to the surface said wire rope, wherein said wire rope facilitates the transfer of the electric power and signal transmission 45,46 between the surface and the bottom hole assembly;

iii a discharge fluid circulating pump 62 or a plurality of such pumps 62 said pumps having sufficient capacity to supply the volumes of discharge fluid at the necessary pressure as set forth by the operating characteristics of the drill-bit 1 and the dimensions of the borehole, and wherein the pumps are situated at the surface above the borehole.

iv hoisting and handling capability 48,49 and power 47 to lower and lift the bottom hole assembly 42 and the borehole pipe conduit 44 or steel wire rope 65 routinely into and out of the borehole and further characterized by that the hoisting and handling facilities are situated at the surface above the borehole;

v electric power generation and transforming capability 47 sufficient to power all bottom-hole assembly 42 functions and surface power requirements said bottom-hole assembly power to be transferred through the borehole at a practical voltage level such as 1000 VAC but not necessarily limited to this exact value, and wherein the power and transforming facilities are situated at the surface above the borehole;

vi a discharge fluid composed of diesel or transformer oil or another oil or composition of oils with similar permittivity and wherein may be mixed one or a combination of the following substances;

i a discharge fluid specific-gravity regulator for the purpose of borehole pressure control and in the form of a suitable mineral such as but not limited to barite;

ii a viscosity regulator for the purpose of improved lifting of cuttings to the surface such as but not limited to a polymer composite, said discharge fluid further characterized by that its storage and handling facilities are situated at the surface above the borehole;

vii a discharge fluid flow scheme characterized by a flow path from the surface to the drill-bit 1 and back to the surface, said flow path being internal in a tube 44 down the borehole through a terminal connection 55 at said bottom hole assembly's 42 upper extension, through or past the motor 33, through or past the drilling process control and actuator system 32, through or past the pulse generator 31 or pulse generators 31, through or past the drill-bit 1 boss, through the nozzles 7 and along the open channels on the bit face in the preferred cuttings' exit direction 13 returning by a switch of direction said previously presented direction being generally axial to the borehole away from the hole-bottom back to the surface past the bottom hole assembly 42 in the annulus surrounded by the bore-hole and said bottom-hole assembly 42 and past said tube 44 in the annulus surrounded by the bore-hole and said tube 44 carrying with it the cuttings in suspension to the surface and said discharge fluid flow scheme further characterized by that it receives an energy charge from the pumps at the surface above the borehole in sufficient quantities to complete its flow loop with volume flow and pressure drops as necessary;

viii a discharge fluid cleaning, mixing and holding system 61 in compliance with good health and environmental standards and the relevant law characterized by that the system is situated at the surface above the borehole;

ix a borehole pressure control and management system 56 as may be deemed necessary for the purpose of handling excessive borehole pressures characterized by that the pressure control system is situated at the surface above the borehole;

x a borehole information sampling and processing system and facilities for drilling process control 56 characterized by that the information sampling, processing and drilling control systems are situated at the surface above the borehole.

58. A drilling machine 43 according to claim 34 for the drilling of boreholes in the ground by the utilization of electric discharge generated by high-voltage pulses between electrodes 4,5 of opposite polarity, said machine characterized by a bottom hole assembly 42 and surface drilling support machinery 47, 48, 53, 56 said surface drilling support machinery incorporating a combination of all or some the following sub-systems, wherein i a hoisting and handling system 48,53 to lower and lift the bottom hole assembly 42 and steel wire rope 65 routinely into and out of the borehole and further characterized by that the hoisting and handling system is situated at the surface above the borehole;

ii electric power generation and transforming capability 47 sufficient to power all bottom-hole and surface power requirements and further characterized by that power generation system is situated at the surface above the borehole;

iii borehole information sampling and processing capability 56, and facilities for drilling process control working in conjunction with the similar down-hole drilling control and steering system and further characterized by that said control system is situated at the surface above the borehole;

iv a storage supply of discharge fluid composed of diesel or transformer oil or another oil or composition of oils with similar permittivity, specific gravity regulators for the purpose of borehole pressure control if necessary and in the form of a suitable mineral such as but not limited to barite, viscosity regulators for the purpose of improved lifting of cuttings to the surface if necessary such as but not limited to polymer composites and other optional composition elements as may from time to time be required and further characterized by that the hoisting and handling system is situated at the surface above the borehole and further characterized by that the storage system is situated at the surface above the borehole and serving in a supplementary role to the down-hole circulating system;

v a discharge fluid handling system 61 in compliance with good health and environmental precautionary standards and the relevant law and further characterized by that the discharge fluid handling system is situated at the surface above the borehole;

vi a borehole pressure control and management system 56 as may be deemed necessary for the purpose of handling excessive borehole pressures, and further characterized by that the hoisting and handling system is situated at the surface above the borehole;

and wherein the discharge fluid circulation takes place only in a limited loop at the bottom of the hole said circulation loop extending from said bottom roughly to the top of said bottom-hole assembly 42 while the rest of the borehole remains empty or fluid-filled as may be required by the surrounds of the borehole or other considerations.

* * * * *